US010706679B2

(12) United States Patent
Cohen et al.

(10) Patent No.: US 10,706,679 B2
(45) Date of Patent: Jul. 7, 2020

(54) ELECTRONIC WAGERING SYSTEM EMPLOYING MACHINE-READABLE OPTICAL CODES

(71) Applicant: IGT, Las Vegas, NV (US)

(72) Inventors: Charles Philip Cohen, London (GB); Christian Mario Bugno, London (GB)

(73) Assignee: IGT, Las Vegas, NV (US)

( * ) Notice: Subject to any disclaimer, the term of this patent is extended or adjusted under 35 U.S.C. 154(b) by 66 days.

(21) Appl. No.: 15/167,615

(22) Filed: May 27, 2016

(65) Prior Publication Data

US 2017/0345256 A1 Nov. 30, 2017

(51) Int. Cl.
*G07F 17/32* (2006.01)

(52) U.S. Cl.
CPC ..... *G07F 17/3244* (2013.01); *G07F 17/3225* (2013.01); *G07F 17/3241* (2013.01)

(58) Field of Classification Search
CPC ..... G07F 17/3225; G07F 17/3241; G07F 17/3244
See application file for complete search history.

(56) References Cited

U.S. PATENT DOCUMENTS 3,732,559 A * 5/1973 Eichelberger ..... G09G 1/20 345/24
9,921,658 B2 * 3/2018 Midholt ..... G06F 3/017
2004/0082384 A1 * 4/2004 Walker ..... G07F 17/32 463/40
2006/0009278 A1 * 1/2006 Vancura ..... G07F 17/3244 463/25
2008/0294808 A1 * 11/2008 Mahalingam ..... G06F 13/105 710/26
2011/0161076 A1 * 6/2011 Davis ..... G06F 3/04842 704/231
2012/0221514 A1 * 8/2012 Knight ..... G06F 17/30038 707/610
2013/0137509 A1 * 5/2013 Weber ..... G07F 17/3223 463/29
2014/0342820 A1 11/2014 Nelson et al.
2016/0259951 A1 * 9/2016 Pececnik ..... G07F 17/3223

* cited by examiner

*Primary Examiner* — Werner G Garner
(74) *Attorney, Agent, or Firm* — Sage Patent Group

(57) ABSTRACT

An electronic wagering system may include a wager selection station, a server, and a software application executed by a mobile communication device. At least one processor of the wager selection station may accept user input specifying parameters of an event on which to place a wager, generate a unique reference from which the specified event parameters are derivable, encode the unique reference in a machine-readable optical code, and display the generated optical code. The software application may operate the user's mobile communication device to scan the displayed optical code, retrieve the unique reference by decoding the scanned optical code, transmit the unique reference to the server for deriving the specified event parameters from the unique reference at the server, receive user input to place a wager on the event with the specified parameters, and transmit a request to the server to place the wager on behalf of the user.

20 Claims, 12 Drawing Sheets

| TIME | TEAM | SPREAD | MONEY | TOTAL | |
|---|---|---|---|---|---|
| NBA Games | | | | | |
| 19:00 EDT | Boston Celtics | +7 ☐ (-120) | +210 ☒ | O 205 ☐ (-115) | More |
| | Atlanta Hawks | -7 ☐ (-130) | -250 ☐ | U 205 ☐ (-115) | |
| MLB Games | | | | | |
| 20:30 EDT | Los Angeles Angels | +1.5 ☐ (-155) | +142 ☐ | O 8.5 ☐ (-110) | More |
| | Chicago White Sox | -1.5 ☐ (+135) | -157 ☐ | U 8.5 ☐ (-110) | |
| | | | Submit Selections | | |

FIG. 3A

ELECTRONIC WAGERING SYSTEM EMPLOYING MACHINE-READABLE OPTICAL CODES

BACKGROUND

Many casinos, racetracks, and other gaming establishments have a designated room or area called the "sportsbook" that is dedicated to wagering on sports competitions. These areas typically have a seating area and large television screens where patrons can view sports competitions that are currently going on, as well as betting windows where bets can be placed with the casino personnel operating the betting windows. There are also stand-alone sportsbooks that operate in brick-and-mortar establishments separate from any casino, as well as dedicated retail outlets and betting windows or terminals in bars, convenience stores, and other locations not exclusive to gambling. Increasingly, online sportsbooks have emerged that accept sports wagers from users over the Internet, without any brick-and-mortar venue for the patrons to physically visit. A user of an online sportsbook can place wagers with the sportsbook from any physical location permitted by law by uploading wager selections from the user's computing device to the sportsbook's server via an Internet connection.

There are many different types of wagers that can be placed in a sportsbook, whether online or brick-and-mortar. One popular type of wager is a "moneyline" wager, in which a patron bets on which team or player will win a particular sports competition, and the odds calculated by the sportsbook operator determine the payout percentage if the patron wins the bet. Another popular type of sports wager is a "spread" wager, in which the patron bets that a particular team or player will win a particular sports competition by at least a particular number of points (the "point spread") over the losing team or player. Again, the sportsbook operator typically calculates the odds of a particular spread which determines the payout percentage if the patron wins the bet. Another popular type of sports wager is an "over-under" wager, in which the sportsbook operator typically predicts the number that will result for a particular statistic in a particular sports competition (typically the total number of points that will be scored by both teams/players combined), and the patron places a bet on whether the actual result for that statistic will be over (greater than) or under (less than) the number predicted. Other types of sports wagers are typically called "proposition" wagers/bets (as well as other names, such as "prop bets," "exotic bets," "novelty bets," etc.), and can be placed on the occurrence any of numerous forms of events that could occur in the context of the sports competition without necessarily being tied to the final outcome of the entire competition. Examples could include whether a particular player will score on a particular play at a particular point in time during the competition; which player will score the first points in the competition; how many times the sports commentators will say a particular word during the sports competition; or any other event related to the sports competition for which the sportsbook may decide to calculate odds.

Many sportsbooks also offer combination wagers, such as "parlays," "teasers," "if bets," etc., which combine two or more "straight bets" (e.g., moneylines, spreads, over-unders, props, etc.) according to particular rules. For example, in a parlay wager, the patron combines two or more straight bets, and must win all of the combined straight bets in order to win the parlay. An example of a parlay is a bet that one particular team will win one particular sports match and another particular team will win another particular sports match being played on the same or different days. If any of the individual straight bets are lost (e.g., if one of the teams does not win its match), then the entire parlay is lost. However, if the parlay is won by winning all of the combined straight bets (e.g., if both teams win their respective matches), then the payout is typically larger than the combined payouts of the individual straight bets would have been if they had been placed separately instead of in parlay. Sportsbooks may also offer combinations of parlay bets, such as "round robins," in which the patron is able to bet on all combinations of parlays of a particular number of picks from within a selection made by the patron. For example, if the patron has selected five games, a round robin by threes would place parlays consisting of all possible combinations of three of the five games. In a round robin, the loss of a single straight bet within the combination causes the patron to lose any of the parlays within the round robin that include that straight bet, but not the others.

SUMMARY

One type of embodiment is directed to an electronic wagering system comprising: a wager selection station having at least one output display and at least one user input mechanism, the wager selection station being operatively coupled to at least one processor with least one storage medium storing processor-executable instructions that cause the at least one processor of the wager selection station to: accept, via the at least one user input mechanism, user input specifying one or more parameters of an event on which to place a wager; generate a unique reference from which the specified event parameters are derivable; encode the unique reference in a machine-readable optical code; and display the generated machine-readable optical code on the at least one output display; a server comprising at least one processor and at least one storage medium storing processor-executable instructions that cause the at least one processor of the server to derive the user-specified event parameters from the unique reference; and a software application comprising a set of software instructions that, when executed by a mobile communication device of the user, operate the user's mobile communication device to: scan the displayed machine-readable optical code from the at least one output display of the wager selection station via an imaging device of the mobile communication device; retrieve the unique reference by decoding the scanned machine-readable optical code; transmit the decoded unique reference to the server via a network communication interface of the mobile communication device, for deriving the specified event parameters from the unique reference at the server; receive user input at the mobile communication device to place a wager on the event with the specified parameters derived from the unique reference at the server; and transmit a request to the server to place the wager on behalf of the user.

Another type of embodiment is directed to a wagering server system comprising at least one network communication interface, at least one processor, and at least one storage medium storing processor-executable instructions that, when executed by the at least one processor, perform a method comprising: receiving, from a wager selection station via the at least one network communication interface, parameters of an event on which to place a wager, specified by user input entered via the wager selection station; generating a unique reference from which the specified event parameters are derivable at the server, the unique reference being suitable for encoding in a machine-readable optical code; transmitting the generated unique reference to the wager selection station for encoding and display to the user as the machine-readable optical code at the wager selection station; receiving, from a mobile communication device of the user via the at least one network communication interface, the unique reference having been decoded from the machine-readable optical code scanned by the user's mobile communication device from the wager selection station; deriving the user-specified event parameters from the unique reference received from the mobile communication device; and placing a wager on behalf of the user on the event with the specified parameters derived from the unique reference.

Another type of embodiment is directed to at least one non-transitory processor-readable storage medium storing processor-executable instructions that, when executed by at least one processor of a mobile communication device, perform a wagering method comprising: scanning a machine-readable optical code via an imaging device of the mobile communication device; retrieving a unique reference by decoding the machine-readable optical code; transmitting the unique reference, via a network communication interface of the mobile communication device, to a server for deriving from the unique reference, at the server, one or more specified parameters of an event on which to place a wager; receiving from the server, via the network communication interface, the specified event parameters derived from the unique reference at the server; receiving user input at the mobile communication device to place a wager on the event with the specified parameters; and transmitting a request to the server to place the wager on behalf of the user.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 3A illustrates an exemplary user interface of a wager selection station in accordance with some embodiments;

DETAILED DESCRIPTION

Figure 1:
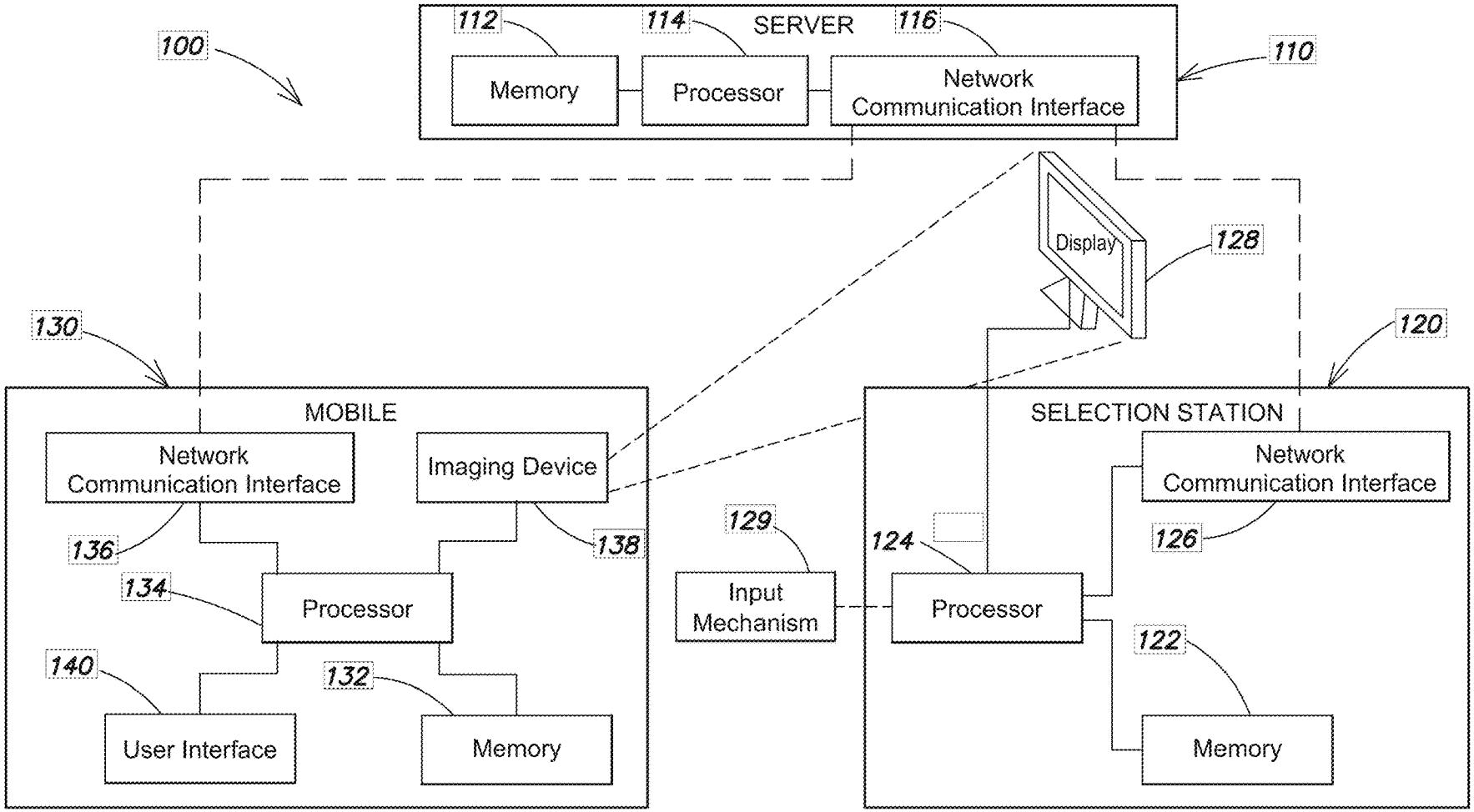
FIG. 1 is a block diagram illustrating an exemplary operating environment for an electronic wagering system in accordance with some embodiments.

Some embodiments described herein relate to techniques for electronic wager selection and placement that may improve the operation of an electronic wagering system, as described herein.

In some embodiments, an electronic wagering system may be provided, including a wager selection station (e.g., a kiosk, an interactive display screen, a multimedia device such as a television or computer terminal, etc.) having at least one output display and at least one user input mechanism. (In some embodiments, the output display and the input mechanism may be integrated, e.g., in the form of a touchscreen. In other embodiments, there may be an input mechanism separate from the output display, such as a keyboard, mouse, one or more selection buttons, etc.) The wager selection station may be programmed and/or remotely controlled to provide functionality allowing a user to select parameters specifying an event on which to place a wager. For example, in some embodiments, the output display may display various selectable event parameters, and the user may operate the input mechanism to select certain parameters to specify the event on which the user wishes to wager. Such parameters could include, for example, in a sportsbook environment, the particular sports match(es) on which the user would like to wager, the particular sports team(s) and/or player(s) on which the user would like to wager, particular play(s) on which the user would like to wager, particular predicted score(s) on which the user would like to wager, particular predicted score difference(s) (e.g., point spreads) on which the user would like to wager, particular time period(s) for an event on which the user would like to wager, etc. These are merely some examples, however, as any suitable parameter(s) of any suitable event on which to place a wager may be specified in some embodiments.

In some other embodiments, a bookmaker or agent of a bookmaker (such as a marketer) may define a selection in advance, e.g., through an interface not available to the customer. This capability may be used, for example, to offer selections or prices that are not available to customers through other mechanisms, or may include a promotional price or other offer that is not otherwise available to customers. However, not all embodiments are so limited; in some embodiments, a bookmaker may pre-define selections of event parameters that may define wagers that could have been selected by a customer. The preselections in such cases may add, for example, speed and/or efficiency to the wagering process.

In some embodiments, once user input specifying one or more parameters of an event on which to place a wager has been accepted via the wager selection station, the system may generate a unique reference from which the specified event parameters are derivable. The unique reference may be, for example, a character string (numeric, alphanumeric, symbolic, etc.), a number, a binary number/string, or any other suitable reference (e.g., code) from which the specific set of selected event parameters may be derived. In some embodiments, the unique reference may be generated from the specified event parameters by execution of stored program instructions by one or more processors operatively coupled to the wager selection station. In some embodiments, the processor(s) generating the unique reference from the specified event parameters may be local to the wager selection station. In other embodiments, the processor(s) generating the unique reference may be located remotely from the wager selection station, e.g., at a server. In some embodiments, an algorithm or other process applied to the specified event parameters to generate the unique reference may be proprietary to an entity that owns, operates, or controls the device(s) at which the unique reference is generated, such that the event parameters cannot be derived from the unique reference by other entities or at other devices that do not have access to or knowledge of the proprietary algorithm or other process.

In some embodiments, the unique reference from which the specified event parameters are derivable (e.g., via reverse application of the proprietary algorithm/process) may be encoded in a machine-readable optical code that may be displayed on the output display of the wager selection station and/or any other suitable display. Alternatively or additionally, the machine-readable optical code may be printed on a non-electronic medium, or may be displayed to potential bettors in any other suitable way. The optical code may be any suitable form of machine-readable optical code, including but not limited to a one-dimensional optical code such as a barcode, a two-dimensional optical code such as a matrix barcode (e.g., a QR code), etc.

In some embodiments, displaying the optical code at the wager selection station may allow the user to scan the optical code with the user's mobile communication device, thereby transferring to the user's mobile communication device the encoded unique reference from which the specified event parameters of the wager to be placed may be derived. As used herein, the term "mobile communication device" or "mobile device" refers to any device having processing capability as well as network communication capability (e.g., cellular data network, wired and/or wireless Internet, etc.), that is designed to be carried by its user while in use. The scanning may be performed by a software application executing on the mobile device, which may operate the mobile device's imaging device (e.g., camera, laser scanner, or any other suitable imaging device) to capture the optical code. The software application may then execute a stored public decoding algorithm to retrieve the unique reference by decoding the scanned machine-readable optical code.

Providing a machine-readable optical code in this fashion may allow a unique reference from which the wager parameter selections are derivable to be efficiently transferred to the user's own mobile device for later placing the wager, without requiring any personal or financial information of the user to be input or transferred to the wager selection station or shared insecurely with anyone in the sportsbook venue, thereby improving the security and efficiency of the electronic wagering system. Also, the displayed optical code encoding the unique reference from which the wager event parameters are derivable may be quickly and easily scanned by other users as well who may choose to wager on the same event, such that those users may avoid the need to individually re-select and re-input each of the parameters defining the event on which to wager.

In some embodiments, the unique reference decoded at the user's mobile device may be transmitted from the mobile device via any suitable network communication interface to a server for deriving the specified event parameters from the unique reference. This may be the same or a different server from the server that may generate the unique reference initially. The server receiving the unique reference from the mobile device may apply an algorithm/process related to that used to generate the unique reference, and may thereby derive the specified event parameters defining the event on which a wager is to be placed. When the user then decides to go ahead and place the wager on the event with the specified parameters, in some embodiments the user may then input an instruction via the mobile device, and the mobile device may transmit a request to the server to place the wager on behalf of the user on the event with the specified parameters derived at the server. Thus, in some embodiments, the user's personal and/or financial information involved in placing the wager transaction may be transmitted (e.g., securely) only between the user's own mobile communication device and the sportsbook server, or may already be held on the server in an account associated with the user, without need for involving the wager selection station or sportsbook personnel in this portion of the wager process.

It should be appreciated that the foregoing description is by way of example only, and some embodiments are not limited to providing any or all of the above-described functionality, although some embodiments may provide some or all of the functionality described herein. Also, it should be appreciated that while specific examples of applications of inventive techniques are described herein with reference to sports wagering, many of the techniques described herein are not so limited, and may alternatively or additionally be applied to any of various other suitable types of wager placements, including but not limited to pari-mutuel race wagers, wagers on non-sporting events such as elections, entries into lotteries (e.g., lottery "tickets" purchased by scanning an appropriate optical code), contests and/or fantasy league events, etc.

The inventive concepts described herein can be implemented in any of numerous ways, and are not limited to any particular implementation techniques. Thus, while examples of specific implementation techniques are described below, it should be appreciated that the examples are provided merely for purposes of illustration, and that other implementations are possible.

One illustrative application for techniques described herein is for use in an electronic wagering system 100. An exemplary operating environment for such a system is illustrated in FIG. 1 and includes server 110, wager selection station 120, and mobile device 130. The operating environment illustrated in FIG. 1 may be associated with any suitable venue where wagering activities may be carried out. For example, in some embodiments, wager selection station 120 may be installed in a wagering venue such as a casino, a sportsbook area in a casino, a standalone sportsbook venue, or any other suitable venue (e.g., an airport, another type of transportation terminal, a restaurant, a store, etc.). In some embodiments, wager selection station 120 may be provided as a device by which a user may specify the parameters of an event on which the user might like to place a wager, and wager selection station 120 may provide a mechanism by which the user may obtain data representing those event parameters and present that data to server 110 to place the wager. For example, in some embodiments, wager selection station 120 may display a machine-readable optical code generated from the user's selected event parameters, and the user may operate mobile device 130 (which may be the user's own mobile device, in some embodiments) to scan the optical code. The optical code may encode a unique reference from which the event parameters specified by the user are derivable. The user may operate mobile device 130 to transmit to server 110 the unique reference and request that a wager be placed on the specified event. Server 110 may then derive the event parameters from the unique reference and place a wager on the event with the specified parameters on the user's behalf.

In some embodiments, a request to place the wager may be transmitted from mobile device 130 to server 110 separately from the transmission of the unique reference from which the event parameters are derived. For example, in some embodiments, the event parameters derived from the unique reference at server 110 may be transmitted back to mobile device 130 for presentation to the user, and the user may further review the event parameters before submitting a separate request to place the wager. In some embodiments, alternatively or additionally, the user may enter via mobile device 130 a monetary amount of the wager to be placed, and then may transmit a request (e.g., including the monetary amount) to the server to place the wager. In some other embodiments, transmission of the unique reference from the mobile device 130 to server 110 may act as a request to place the wager on the user's behalf, rather than transmitting a separate request to place the wager. For example, in some embodiments, a monetary amount of the wager may be selected and/or otherwise specified by the user via wager selection station 120. In some such embodiments, both the monetary amount of the wager and the specified event parameters may be derivable from the unique reference generated based on these information. In this manner, in some embodiments, the unique reference may later be used by server 110 to derive the specified event parameters and the monetary amount of the wager, and the user may not need to see, verify, and/or adjust the monetary amount on his mobile device 130 prior to placing the wager. Accordingly, in some such embodiments, transmission of the unique reference from the mobile device 130 to server 110 may act as a request to place the wager on the user's behalf, rather than having the user provide a monetary amount and/or enter separate input to place the wager on his mobile device 130.

Devices in the exemplary operating environment depicted in FIG. 1 may be implemented in any suitable form, as embodiments are not limited in this respect. For example, server 110 and wager selection station 120 may each be implemented as a single stand-alone machine, or either may be implemented by multiple distributed machines that share processing tasks in any suitable manner. For example, in some embodiments, some or all processing tasks for the wager selection station 120 may be performed by an external server and the wager selection station 120 may act as a user terminal for the external server for some or all functions. Server 110, wager selection station 120, and/or mobile device 130 may be implemented as one or more computers; an example of a suitable computer is described below. In some embodiments, server 110, wager selection station 120, and/or mobile device 130 may include one or more tangible, non-transitory processor-readable storage devices (e.g., memory 112, memory 122, and/or memory 132) storing processor-executable instructions, and one or more processors (e.g., processor(s) 114, processor(s) 124, and/or processor(s) 134) that execute the processor-executable instructions to perform functions described herein. The storage devices may be implemented as computer-readable storage media (i.e., tangible, non-transitory computer-readable media) encoded with the processor-executable instructions; examples of suitable computer-readable storage media are discussed below. Server 110, wager selection station 120, and/or mobile device 130 may include one or more network communication interfaces (e.g., interface(s) 116, interface(s) 126, and/or interface(s) 136) suitable for communicating with one or more other devices over one or more wired and/or wireless networks such as one or more local networks (e.g., LAN) and/or wide area networks (e.g., Internet). In some embodiments, server 110 may be local to the venue (e.g., sportsbook) where wager selection station 120 is located, and server 110 and wager selection station 120 may communicate over a local area network. In some embodiments, server 110 may be at a remote location from the sportsbook venue, and server 110 and wager selection station 120 may communicate over a wide area network.

Wager selection station 120 may include at least one output display 128 and/or one or more user input mechanisms 129. In some embodiments, display 128 and input mechanism 129 may be integrated (e.g., in the form of a touchscreen). In other embodiments, user input mechanism 129 may be separate from display 128, such as in the form of a keyboard, mouse, one or more physical selection buttons, etc. Display 128 may be installed in any suitable location within a sportsbook or other suitable venue accessible to patrons of the venue. For example, one or more displays 128 may be located on tables and/or walls inside the sportsbook, as a free-standing machine, and/or in some embodiments, may be located outside the sportsbook or other venue. While exemplary embodiments are described below with reference to a sportsbook venue, it should be understood that any of the disclosed embodiments may alternatively be located in a different type of venue.

In some embodiments, display 128 may be used by wager selection station 120 to present to a patron of the sportsbook (or other user) one or more selectable parameters of events on which wagers may be placed, and/or may provide any other suitable form in which the user may provide input specifying one or more parameters of an event on which to place a wager. Any suitable event parameters may be used, as embodiments are not limited in this respect. For example, one type of event parameter may be a sports match in which the event is to occur. Information specifying the sports match may include, for example, time and/or date information identifying when the sports match is planned to occur, the type of sport played during the sports match (e.g., football, basketball, hockey), and/or a league or association (e.g., National Football League, National Basketball Association) coordinating the sports match. Another type of event parameter may be one or more sports teams to be involved in the event. In some cases, information specifying a sports team may identify the sports team as participating in a sports match (e.g., a basketball game with the Celtics playing). In another example, an event parameter may be one or more sports players to be involved in the event (e.g., a sports player of one of the sports teams participating in the sports match). In another example, event parameters may include one or more predicted winners of one or more specified sports matches. Another type of event parameter may be one or more plays to be performed in the event (e.g., a number of touchdowns during a football game, a number of strikeouts achieved by a pitcher during a baseball game, etc.). In another example, an event parameter may be one or more scores to be achieved in the event (e.g., a total number of points scored by one or more teams during a sports match). Another type of event parameter may be one or more score differences to be achieved in the event (e.g., a difference between the number of points one team scores and the number of points another team scores during a sports match). In another example, an event parameter may be one or more specified time periods in which the event is to occur (e.g., a quarter, half, inning, etc., in which the user wagers that a particular player will perform a particular play, achieve a particular score, etc.).

In some embodiments, one or more event parameters selected by a user may collectively specify an event on which to place a wager. For example, a user may provide selections of the sports team parameters "Celtics" and "Hawks," a time period parameter "1$^{st}$ half," and a score parameter "50," which may collectively specify the Celtics scoring 50 points during the 1$^{st}$ half of the Celtics vs. Hawks basketball game as an event on which the user may place a wager. In some embodiments, wager selection station 120 may present a selectable option that groups event parameters specifying an event on which a wager may be placed, such that the user may input a single selection to select the event and collectively specify the event parameters. As an example, wager selection station 120 may provide a selectable option of an event in which the total number of points scored by both sports teams in a particular sports match is over 60, which may be used to select an over-under event wager. As another example, user selection of an option specifying a predicted winner of a particular sports match may be used to select a moneyline wager.

In some embodiments, wager selection station 120 may present (e.g., via display 128) wagering odds associated with event parameters, where the odds may be calculated by one or more systems controlled by the sportsbook operator, and may be used to determine the payout percentage if the user places and wins the wager on the event specified by those parameters. For example, in some embodiments, server 110 may calculate and store the wagering odds and communicate the wagering odds by transmitting information identifying the wagering odds from network communication interface 116 to network communication interface 126 of wager selection station 120. Wager selection station 120 may then update display 128 to display updates to the wagering odds for different event parameters. Alternatively, in some embodiments, wagering odds may be computed by a different server than server 110, and/or may be computed locally at wager selection station 120.

In some embodiments, wager selection station 120 may use display 128 to present a graphical user interface configured to allow a user to navigate among different options for event parameters. Event parameters may be organized in the user interface in any suitable way, such as, e.g., by sports match and/or by scheduled time for the sports match. In some embodiments, the graphical user interface of display 128 may include a search functionality that allows the user to enter a search query to retrieve and then select one or more event parameters.

A user may provide input specifying one or more event parameters in any suitable way, such as through display 128 and/or user input mechanism 129 of wager selection station 120. In embodiments where display 128 and user input mechanism 129 are integrated in a touchscreen, a user may provide input specifying one or more event parameters by selecting regions of the touchscreen, for example. In such embodiments, wager selection station 120 may not include a separate device/component for user input mechanism 129. Alternatively, in some embodiments, user input mechanism 129 may include a separate device/component such as a keyboard, mouse, dial, one or more selection buttons, and/or any other suitable user input device/component. A user may interact with user input mechanism 129 to provide selections specifying one or more event parameters and/or to navigate through options displayed on display 128.

In some embodiments, once user input specifying one or more event parameters has been received by wager selection station 120, the system may generate a unique reference from which the specified event parameters may be derivable. In some embodiments, generation of the unique reference may be performed by one or more processors operatively coupled to wager selection station 120, having one or more storage media storing processor-executable instructions that cause the processor(s) to perform a process for generating the unique reference. These processor(s) to which wager selection station 120 may be operatively coupled may be local to or remote from wager selection station 120. For example, in some embodiments, generation of the unique reference may be performed by local processor 124. In other embodiments, generation of the unique reference may be performed by one or more processors of a separate and/or remote device such as server 110 or another server, to which wager selection station 120 may be operatively coupled (e.g., via one or more wired and/or wireless direct and/or network connections).

The unique reference may be generated from the specified event parameters in any suitable way. In some embodiments, for example, an algorithm for generating the unique reference from the specified event parameters may be stored on one or more devices of electronic wagering system 100. In some embodiments, the algorithm may be stored on one or more tangible, non-transitory processor-readable storage devices of wager selection station 120 (e.g., memory 122). One or more processors 124 of wager selection station 120 may execute the algorithm to generate the unique reference from the specified event parameters received by the user interacting with the wager selection station 120.

In some embodiments, the algorithm for generating the unique reference from the specified events may be stored on one or more tangible, non-transitory processor-readable storage devices of server 110 (e.g., memory 112). Wager selection station 120 may transmit the specified event parameters to the server 110 by network communication interface 126 transmitting information identifying the specified events to network communication interface 116. One or more processors 114 of server 110 may execute the algorithm to generate the unique reference from the specified event parameters received by wager selection station 120. Server 110 may transmit the unique reference to wager selection station 120 by network communication interface 116 transmitting information identifying the unique reference to network communication interface 126.

The unique reference generated by electronic wagering system 100 may have any suitable form. For example, in some embodiments, the unique reference may be a character string (e.g., numeric, alphabetic, alphanumeric, symbolic, etc.), a number, a binary string, or any other suitable reference that uniquely corresponds to the specified event parameters, such that the specified event parameters may be uniquely derived from the reference, e.g., by applying the reversal of the process used to generate the unique reference from the event parameters. In some embodiments, electronic wagering system 100 may compress the data form of the unique reference, which may facilitate easier storage of the unique reference and/or transmission of the unique reference over a network from one device to another in the electronic wagering system 100.

In some embodiments, an algorithm or other process applied to the specified parameters to generate the unique reference may be propriety to an entity that owns, operates, or controls the wager selection station 120 and/or server 110 (e.g., the sportsbook operator). In other embodiments, electronic wagering system 100 may generate the unique reference in a non-propriety manner by applying an algorithm or other suitable process that is not specific to an entity associated with the wager selection station 120 and/or server 110.

In one example of a process for generating a unique reference, a look-up table of sub-strings associated with different possible event parameters may be stored and used to build a string of concatenated substrings associated with the specified event parameters. The look-up table may include, for example, sub-strings for types of sports (e.g., NFL, NBA), different teams (e.g., Patriots, Hawks), types of wagers (e.g., moneyline, spread, over-under, exotic bets), the date and/or time of sports matches, possible monetary amounts of wagers, and/or any other suitable event and/or wager parameters. As one specific hypothetical example, a look-up table could include entries that associate "NFL" with the sub-string "123," "Patriots" with the sub-string "xyz," "moneyline" with the sub-string "@#$." The look-up table may be used to generate, from user selections specifying a moneyline wager that the Patriots will win their NFL match on Apr. 28, 2016, a unique reference of "123xyz@#$042816." The same look-up table may then be used in the reverse process to derive the user's wager from the unique reference. Such a look-up table may be kept secret and proprietary to the sportsbook operator in some embodiments, or may be non-proprietary and known to others in other embodiments.

As another specific example, an algorithm or process may dynamically generate strings associated with particular sports matches scheduled to occur. The algorithm or process may generate additional strings as new sports matches are scheduled. The string identifying the sports match may also indicate the two teams competing in the sports match, and may designate the two teams as either "Home" or "Away," in one example. For example, the algorithm or process may generate, for an upcoming sports match in which the Boston Celtics play the Atlanta Hawks, a string of "4567321." Information stored in association with this string may include that the basketball game is being played in Boston, identifying that the Celtics are the "Home" team and the Hawks are the "Away" team. This information may be used to generate a unique reference corresponding to a wager for the "Home" team with a "0" or a wager for the "Away" team with a "1." A look-up table may include entries identifying wager types with different characters, such as "M" for a moneyline wager, "S" for a spread wager, and "T" for an over-under wager. Such a process may generate, for user selections indicating a moneyline wager that the Celtics will win the upcoming Celtics vs. Hawks match, a unique reference of "4567321-0-M." The user selections may be rederived from the reference by reversing this process, by using the code "4567321" to identify that the user's wager is for the Celtics and Hawks game. From "0" and "M," the reverse process may derive that the specified event is that the "Home" team (the Celtics) will win the match, and that the wager is a moneyline wager.

In some embodiments, once a unique reference for the specified event parameters has been generated, the reference may be encoded in a machine-readable optical code. The optical code may be any suitable form of machine-readable optical code, such as but not limited to any form of one-dimensional optical code (e.g., a bar code) or two-dimensional optical code (e.g., a matrix barcode such as a QR code). Any suitable technique(s) for encoding the unique reference in a machine-readable optical code may be used, examples of which are known. Once generated, in some embodiments, the machine-readable optical code may be displayed on display 128 of wager selection station 120.

In some embodiments, the machine-readable optical code may be generated and displayed by execution of stored instructions by one or more processors to which wager selection station 120 is operatively coupled. The processor(s) may be local to or more remote from wager selection station 120. For example, in some embodiments, an algorithm or other process for encoding the unique reference in a machine-readable optical code may be stored on one or more tangible, non-transitory processor-readable storage devices of wager selection station 120 (e.g., memory 122). One or more local processors 124 of wager selection station 120 may execute the algorithm to encode the unique reference in an optical code. In some alternative embodiments, an algorithm or process for encoding a unique reference in a machine-readable optical code may be stored on one or more one or more tangible, non-transitory processor-readable storage devices of a different device, such as server 110 (e.g., memory 112) or another server. One or more processors 114 of server 110 (or another device) may execute the algorithm to generate the optical code from the unique reference. Server 110 may transmit the optical code to wager selection station 120 by network communication interface 116 transmitting information specifying the optical code to network communication interface 126 of wager selection station 120, in some embodiments.

Some embodiments may provide a machine-readable optical code specifying event parameters for a wager to a user in a manner other than by displaying the optical code on a display of a wager selection station 120. Optical codes can be generated in any suitable way and displayed in any suitable location for mobile device users to scan, in some embodiments. For example, in some embodiments, the machine-readable optical code encoding a unique reference specifying one or more event parameters may be printed on a suitable physical medium (e.g., flyer, card). Media having the printed optical code may be distributed among any suitable users, such as, e.g., patrons of a sportsbook venue, which may provide advertising for particular wagers associated with sports match(es). In some embodiments, for instance, an electronic wagering system may not include a wager selection station. In some embodiments, the user may not select event parameters in a wager selection station. For example, in some embodiments, a sportsbook or other wagering facilitator may print flyers and/or display on screens machine-readable optical codes associated with available events for which a user may place a wager, the parameters of which events may be specified by the (sportsbook) operator as opposed to being specified by the user.

In some embodiments, a user may operate a mobile device 130 to scan a machine-readable optical code encoding a unique reference from which event parameters for a wager are derivable. In some embodiments, the mobile device 130 may be owned by the user, and/or may have been brought to the venue by the user. Mobile device 130 may include one or more tangible, non-transitory processor-readable storage devices (e.g., memory 132) storing processor-executable instructions, and one or more processors 134 that execute the processor-executable instructions to perform functions described herein. The storage devices may be implemented as computer-readable storage media (i.e., tangible, non-transitory computer-readable media) encoded with the processor-executable instructions; examples of suitable computer-readable storage media are discussed below.

Mobile device 130 may also include a user interface 140 configured to present information to a user of the device and/or to receive user input. In some embodiments, user interface 140 may include a touchscreen display of the mobile device configured to both present information to a user and receive user input through the user interacting with the touchscreen.

Mobile device 130 may include an imaging device 138, which may be integrated as part of the mobile device 130 (e.g., in the form of a built-in camera of a smartphone or tablet computer) in some embodiments. In other embodiments, imaging device 138 may be external to mobile device 130, which may be configured to communicate with the external imaging device to receive image information. The imaging device 138 may be used to scan the machine-readable optical code, which may be displayed on display 128 of wager selection station 120 for scanning. For example, a user may direct the imaging device 138 at the optical code displayed on display 128 of wager selection station 120 such that the optical code is in the field of view of the imaging device 138. In some embodiments, the optical code may be printed on a physical medium (e.g., flyer, card, poster), and scanning of the optical code may include directing the imaging device 138 to position the optical code on the printed medium within the field of view of the imaging device 138.

In some embodiments, mobile device 130 may execute a software application, which may include a set of software instructions stored, e.g., in memory 132 of mobile device 130. The software application may be specific to the sportsbook or other wagering venue in some embodiments, and a patron of the sportsbook may download the software application onto his mobile device. In some embodiments, the software application may be provided for download by the same server 110 that receives and processes the unique references from the software application to derive specified event parameters for placing wagers. In other embodiments, the software application may be provided from a different server. In some embodiments, the machine-readable optical code scanned using mobile device 130 may include an embedded hyperlink that may direct the mobile device 130 to a web server from which the software application may be downloaded. In some embodiments, the software application may be generic and not specific to any particular wagering system or operator, but may be compatible with multiple operators that use unique references and optical codes to represent event parameters for wagers.

In some embodiments, the software application on mobile device 130 may operate imaging device 138 to scan the machine-readable optical code displayed on wager selection station 120 or displayed on another medium. In other embodiments, the imaging device 138 may be operated by separate software, which may pass the scanned image of the optical code to the wagering system software application. In some embodiments, the software application may include functionality to retrieve the unique reference by decoding the scanned machine-readable optical code. This may be done using any suitable technique(s), e.g., dependent on the technique originally used to generate the optical code, some examples of which are known. In other embodiments, the unique reference may be retrieved from the optical code by separate software, which may pass the retrieved unique reference to the wagering system software application.

Mobile device 130 may also include network communication interface 136 suitable for communicating with other devices over a local network (e.g., LAN) and/or a wide area network (e.g., Internet). In some embodiments, mobile device 130 may communicate over a local area network associated with the sportsbook venue with server 110. In some embodiments, server 110 may be at remote location from the sportsbook venue, and/or the user may relocate with the mobile device 130 to a location remote from server 110 from which mobile device 130 may communicate with server 110, and mobile device 130 may communicate over a wide area network to server 110. For example, in some embodiments, mobile device 130 may use network communication interface 136 to transmit and receive data over the Internet via a cellular data network.

Mobile device 130 may transmit the unique reference decoded from the scanned machine-readable optical code to server 110 via network communication interface 136. In some embodiments, transmission of the unique reference may occur automatically upon decoding the unique reference from the optical code by mobile device 130. In other embodiments, transmission of the unique reference to server 110 may occur in response to receiving user input requesting that the one or more event parameters specified by the unique reference be derived. In some embodiments, the wagering system software application stored in memory 132 of mobile device 130 may operate the mobile device 130 to transmit the decoded unique reference to server 110. The software application may be the same as the software application used to scan the optical code in some embodiments, and may be specific to the sportsbook or other venue operator in some embodiments.

In some embodiments, server 110 may derive event parameters from the received unique reference by applying an algorithm or process to the unique reference received by the server 110 via network communication interface 116. For example, server 110 may apply the reverse of the (proprietary) algorithm/process used to generate the unique reference, and may thereby derive the specified event parameters defining the event on which a wager is to be placed, as discussed above. In some embodiments, server 110 may communicate the specified event parameters to mobile device 130 by network communication interface 116 transmitting information identifying the specified event parameters to network communication interface 136 of mobile device 130, e.g., to display the derived event parameters to the user for confirmation before placing the wager. However, this is not required. In some embodiments, the event parameters derived from the unique reference may not be transmitted back to mobile device 130 from server 110. For example, in some embodiments user confirmation, review, and/or alteration of the event parameters from mobile device 130 may not be required, and server 110 may simply derive the event parameters from the received unique reference and place the wager on the specified event on the user's behalf without further user review.

In some embodiments, the server receiving the unique reference from mobile device 130 may be the same as or different than a server in communication with the wager selection station 120. In some embodiments, for example, electronic wagering system 100 may include at least a first server configured to communicate with one or more wager selection stations and at least a second server configured to communicate with users' mobile devices. Both the first and second servers may have the same algorithm or process stored in the memory of the first and second servers such that a unique reference generated by a first server from specified event parameters from a selection station can be received and correctly processed by the second server to retrieve the event parameters that are uniquely referenced. In some embodiments, the first server may be local to the sportsbook or other venue (e.g., a central server in communication over a local area network with one or more wager selection stations distributed throughout the sportsbook venue) and the second server may be a remote server (e.g., a cloud server accessible over a wide area network).

In some embodiments, a user may share an image of the optical code and/or the decoded unique reference with another user by transmitting the optical code and/or unique reference from the mobile device 130 to a device of another user. The other user may then use the optical code and/or unique reference to obtain the event parameters specified by the optical code and/or unique reference from server 110 and may place a wager on the same event. A user may share the optical code and/or unique reference with another user in any suitable manner, such as via email, text messages, and/or social media networks (e.g., Twitter, Facebook, Instagram), etc. Also, in some embodiments, operators of wager placement services such as sportsbooks, etc., may publish optical codes and/or unique references that they generate on social media for users to scan and/or otherwise use to place wagers on prespecified events.

In some embodiments, server 110 may apply an evaluation process to determine the validity of the event parameters derived from the unique reference. The evaluation process may include determining whether the applicable time period for the event has already passed (e.g., whether the sports match was already played), which may indicate if the event parameters fail to specify an active wager. If the event parameters specify an active wager (e.g., where the match has not yet occurred), then a request provided by a user to place the wager may be granted. If the event parameters specify that a wager that is no longer active, then a request provided by a user to place the wager may be denied. For example, a user may have scanned an optical code on Monday that provides selected event parameters for a sports match on Tuesday. On Monday, the evaluation process applied by the server 110 may provide an indication that a wager for the sports match is still active. However, on Wednesday, the day after the sports match, the evaluation process may provide an indication that the wager is no longer active. In some embodiments, server 110 may recalculate the wagering odds associated with the event parameters derived from the unique reference and communicate updates in the wagering odds by transmitting information identifying the wagering odds from network communication interface 116 to network communication interface 136 of mobile device 130. Mobile device 130 may present any updates in the wagering odds to the user, in some embodiments. In some embodiments, alternatively or additionally, the evaluation process may determine whether the user has sufficient funds in an account to place the wager, and may transmit a notification for display on the mobile device 130 if the user has insufficient funds.

In embodiments in which server 110 transmits event parameters derived from a received unique reference back to mobile device 130 for review by the user, the received event parameters may be presented to the user via user interface 140. In some embodiments, the wagering system software application may operate mobile device 130 to display the graphical user interface on the display. The graphical user interface may allow for the user to adjust the event parameters to update selections for placing a wager, in some embodiments. Alternatively or additionally, in some embodiments the user may provide input indicating a monetary amount of the wager to be placed. In some embodiments, a user may enter in a monetary amount for one or more wagers. In some embodiments, preset monetary values (e.g., monetary values determined by the sportsbook) may populate in the graphical user interface, and a user may select one or more of the preset monetary values.

In some embodiments, the user may provide an input instruction, via the graphical user interface or other suitable input mechanism, requesting to place the wager on the event with the specified parameters on his behalf. This may be done in any suitable way; for example, by selecting a "submit" option for the wager. The request may be transmitted to server 110 by network communication interface 136 transmitting information identifying the request to network communication interface 116 of server 110 to place the wager on behalf of the user on the event with the specified parameters derived at server 110 from the unique reference.

Server 110 may place the wager in response to receiving the request (which may be implicit with the transmission of the unique reference, in some embodiments, or may be a separate request) and in some embodiments may transmit to the mobile device 130 a notification that the request to place a wager has been received. The notification may be in the form of a receipt (e.g., bet ticket) in some embodiments, which may include information indicating the one or more event parameters selected by the user and/or the monetary amount of the wager. The receipt may be used by the user to obtain the payout due if the wager is won. For example, in some embodiments the user may show the receipt on the display of mobile device 130 to an employee of the sportsbook, such as an employee at a cashout counter of the sportsbook. Alternatively, in some embodiments, a financial account associated with the user may be automatically credited with the user's winnings (e.g., by server 110) if the user has won the wager. It should be appreciated, however, that embodiments are not limited to any particular method of recovering the user's winnings, and any suitable method may be used.

Some embodiments may include techniques that provide additional security to authenticate a wager request and/or the user associated with the wager request. In some embodiments, user authentication may be required before transmitting the request to server 110 to place the wager on behalf of the user. The software application operating on the mobile device 130 may request that the user provide authentication information (e.g., account number, login username and/or password, voiceprint or other biometric identification, etc.), which may be used to authenticate the user. The authentication information may be used to provide access to personal and/or financial information (e.g., credit card information, bank information) of the user. In some embodiments, the personal and/or financial information may be stored on mobile device 130, and may be communicated to server 110 in connection with placing a wager request. In some embodiments, the personal and/or financial information may be stored on server 110 (e.g., within a user's account with the sportsbook). A user may provide authentication information on the mobile device 130 which may transmit the authentication information in connection with the wager request to server 110, and the server 110 may access the personal and/or financial information based on the user authentication information received from the mobile device 130.

Authentication information may be received by mobile device 130 in any suitable manner. In some embodiments, a user may enter authentication information through user interface 140 of mobile device 130. Other techniques for receiving authentication information may include fingerprint scanning, voice recognition techniques, eye scanning, passwords, and/or any other suitable authentication techniques. These techniques may involve additional components of the mobile device to receive information identifying the user as being associated with the mobile device, in some embodiments. For example, mobile device 130 may have a fingerprint scanner, e.g., integrated on the "home" or "power" button, which may be used to identify the user as authorized to access the wagering system software application on mobile device 130, in some embodiments. A successful fingerprint scan authenticating the user may be required in some embodiments before the wager request may be transmitted to server 110, for example. In some embodiments, access to the software application operating on the mobile device 130 may terminate after a suitable time period (e.g., a few seconds) of inactivity, which may help to prevent a different (unauthorized) user from operating the mobile device 130 to place a wager request (e.g., fraudulently in the original user's name) A user may be required to re-enter authentication information to access the software application when the application is locked out due to inactivity, in some embodiments.

Figure 2A:
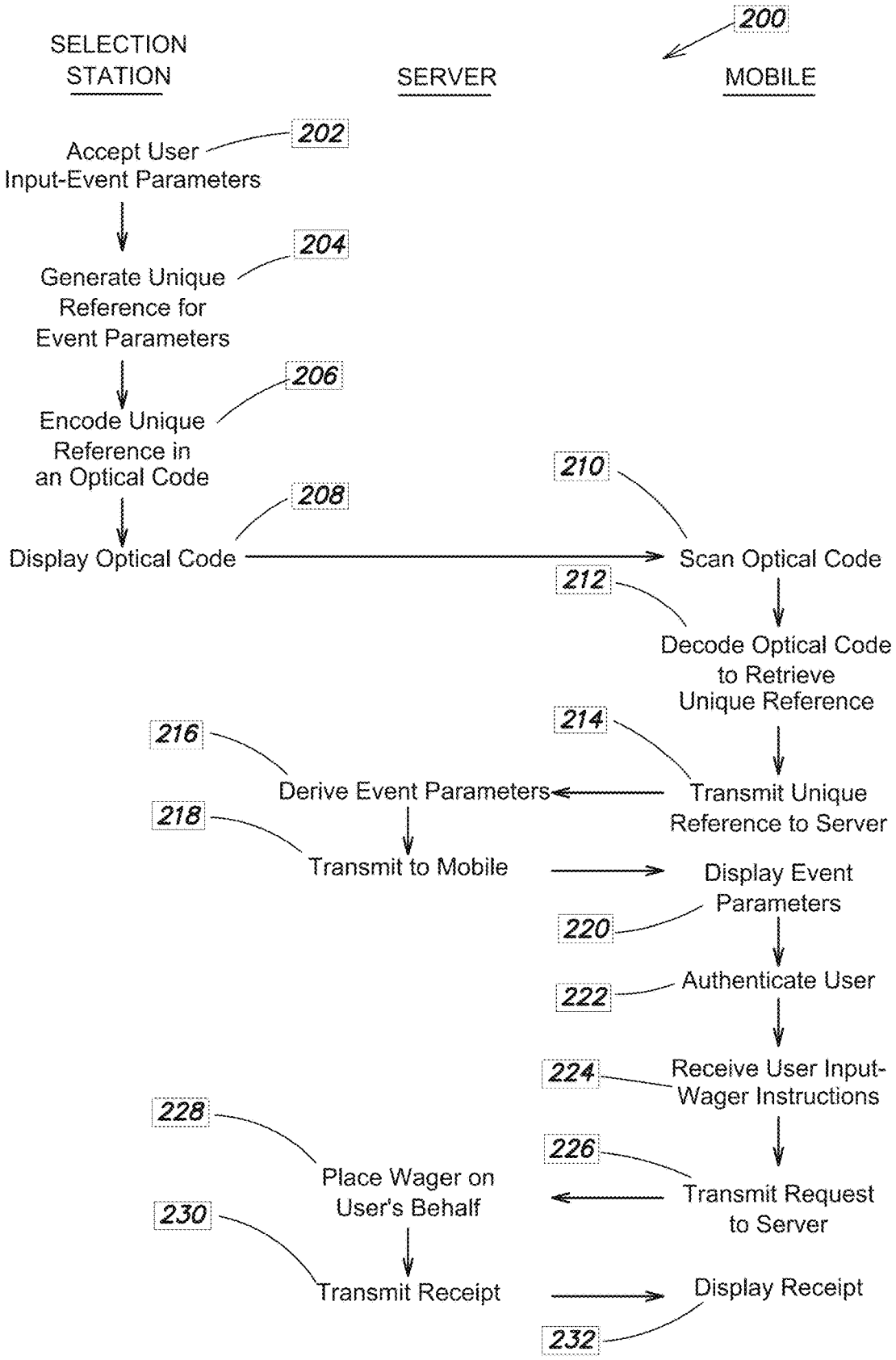
FIG. 2A is a flowchart illustrating an exemplary process of selecting and placing a wager in accordance with some embodiments.

It should be appreciated that one embodiment is directed to a method 200 for placing a wager on behalf of a user, as illustrated in FIG. 2A. Method 200 may be performed, for example, by server 110, wager selection station 120, and mobile device 130, although other implementations are possible. Method 200 begins at act 202, at which a wager selection station may accept user input specifying one or more event parameters. The specified event parameters may define an event on which the user may place a wager. As discussed above, some examples of suitable event parameters may include a specified sports match in which an event is to occur, a specified sports team to be involved in an event, a specified sports player to be involved in an event, a predicted winner of a specified sports match, a specified play to be performed in the event, a specified score to be achieved in the event, a specified score difference to be achieved in the event, and/or a specified time period in which the event is to occur. In some embodiments, the specified event parameters may identify a wager type (e.g., moneyline, spread, over-under, exotic). In some embodiments, a sportsbook venue may determine the types of wagers patrons of the sportsbook may place, and the wager selection station may present these types of wagers to a user of the selection station. Wager selection station may also display wagering odds associated with one or more of the event parameters.

FIG. 3A is a partial example of a user interface display, which may be displayed on a display of a wager selection station, such as display 128 of wager selection station 120. The exemplary user interface lists two types of sports "NBA Games" and "MLB Games" on which a user may wager. For each type of sport, a sports match is identified by the two teams playing in the sports match and time information for the sports match. The Boston Celtics vs. Atlanta Hawks basketball game is listed under "NBA Games" and scheduled at a time of "19:00 EDT." The Los Angeles Angels vs. Chicago White Sox baseball game is listed under "MLB Games" and is scheduled at a time of 20:30 EDT. The user interface specifies different types of wagers a user may place along the heading as "SPREAD" for point spread wagers, "MONEY" for moneyline wagers, and "TOTAL" for over-under wagers. In this example, each different type of wager for a particular sports match is an event parameter contributing to defining a particular event on which the wager would be placed. For example, the top "SPREAD" selection for the Celtics-Hawks game defines an event of the Celtics beating the Hawks by at least 7 points in that match. The top "MONEY" selection for that match defines an event of the Celtics winning the match (regardless of point spread). The top "TOTAL" selection for that match defines an event of the combined score by both the Celtics and the Hawks in that match exceeding 205 points. Wagering odds are also provided on the exemplary user interface for each event, and allow for calculation of the amount of money a patron of the sportsbook would receive if the patron won the wager.

A user may provide input specifying event parameters by selecting the check box next to the desired wager. In the example shown in FIG. 3A, a user has selected the check box next to "+210" specifying that the event on which a wager is to be placed is the event in which the Celtics score more points than the Hawks. A user may finalize these selections by selecting "Submit Selections" on the user interface.

Figure 3B:
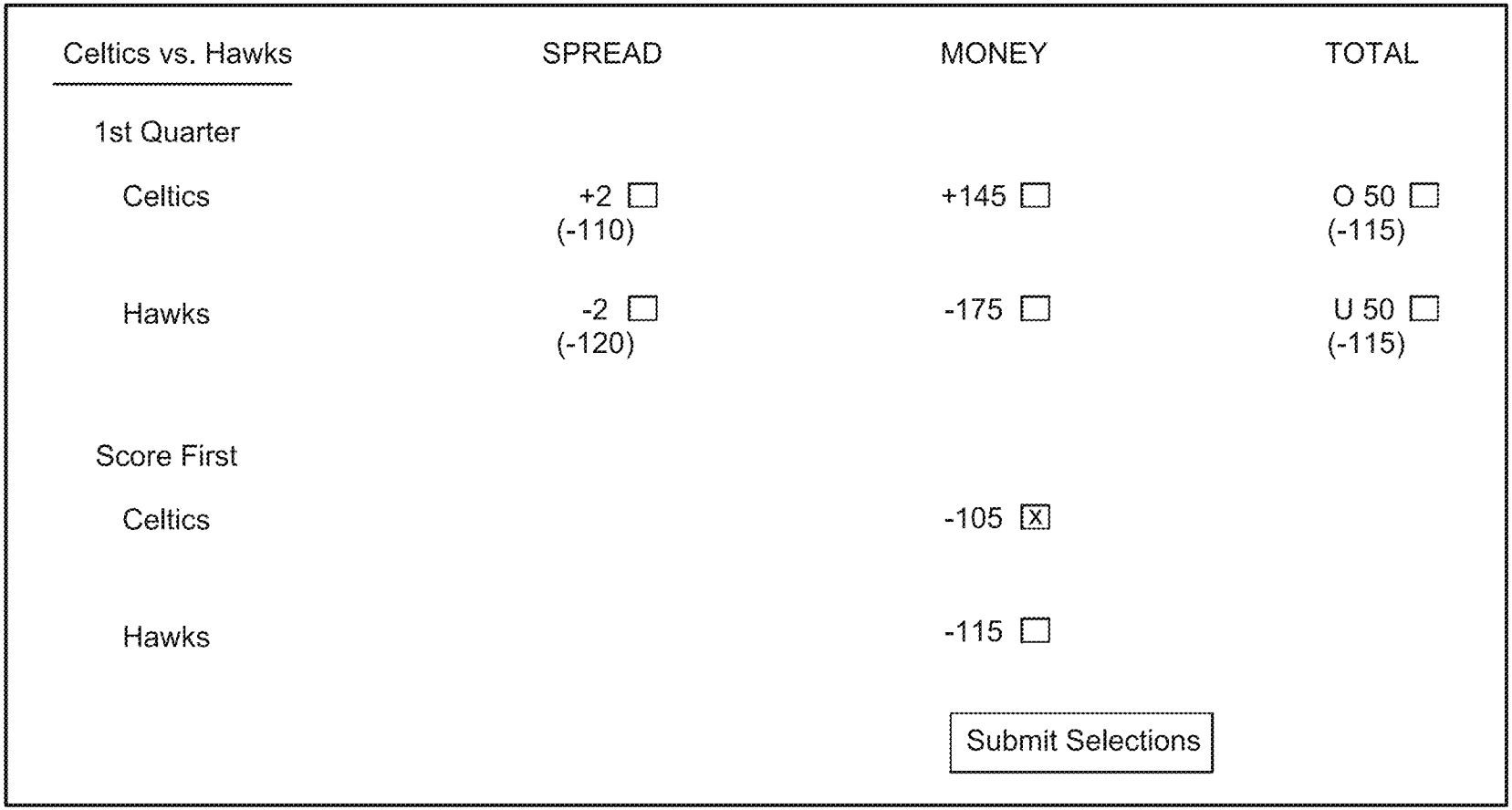
FIG. 3B illustrates an exemplary user interface of a wager selection station in accordance with some embodiments.

A user may navigate the exemplary user interface of FIG. 3A displayed on the wager selection station to view additional events on which wagers may be placed. For example, input selecting the "More" icon associated with the Celtics vs. Hawks game may display additional possible events associated with this match on which wagers may be placed. Some of these additional wagers may be identified as "prop" or "exotic" bets. FIG. 3B illustrates a partial example of a user interface where a user may provide input for additional wagers associated with the Celtics vs. Hawks basketball game, including spread, moneyline, and over-under wagers for the first quarter and which team will score first in the game. User input selection by checking the box next to "−105" under the "MONEY" heading signifies a moneyline wager that the Celtics will score first in the game and has a wagering odd of −105. The user may submit this selection by selecting the "Submit Selections" icon on the exemplary user interface shown in FIG. 3B.

At act 204 of method 200, one or more processors of the wager selection station may generate a unique reference for the specified event parameters indicated by the user input. As discussed above, in some embodiments an algorithm or process may be applied to the specified event parameters to generate a unique reference. At act 206, the processor(s) of the wager selection station may encode the unique reference in a machine-readable optical code. At act 208, the optical code may be displayed on a display of the wager selection station, such as display 128 of wager selection station 120.

Figure 4B:
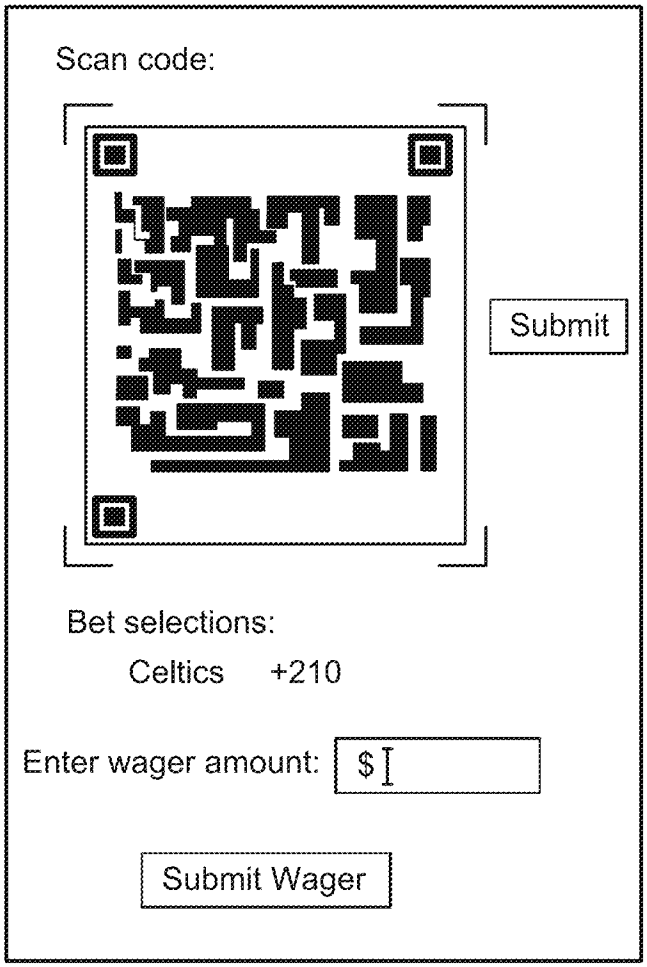
FIG. 4B illustrates an exemplary user interface of a mobile device software application in accordance with some embodiments.
Figure 4A:
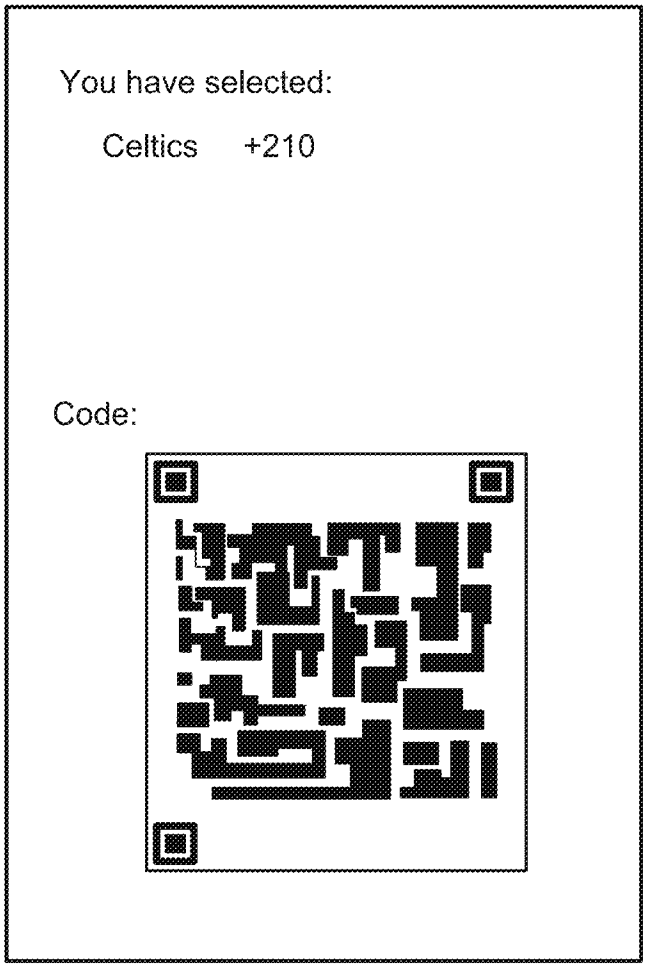
FIG. 4A illustrates an exemplary user interface of a wager selection station in accordance with some embodiments.
Figure 5B:
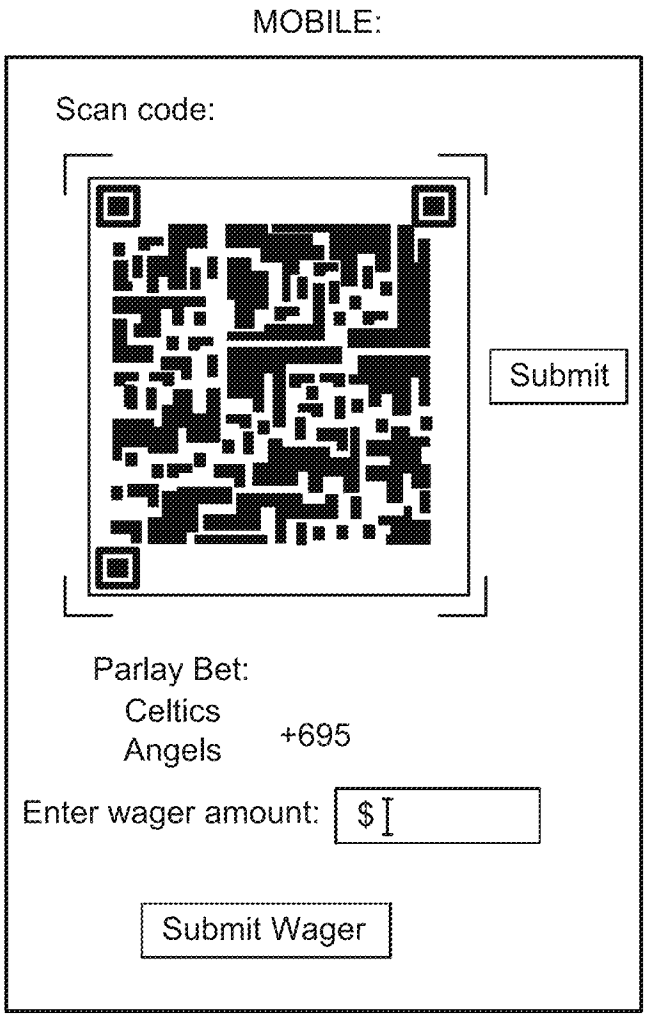
FIG. 5B illustrates an exemplary user interface of a mobile device software application in accordance with some embodiments.
Figure 5A:
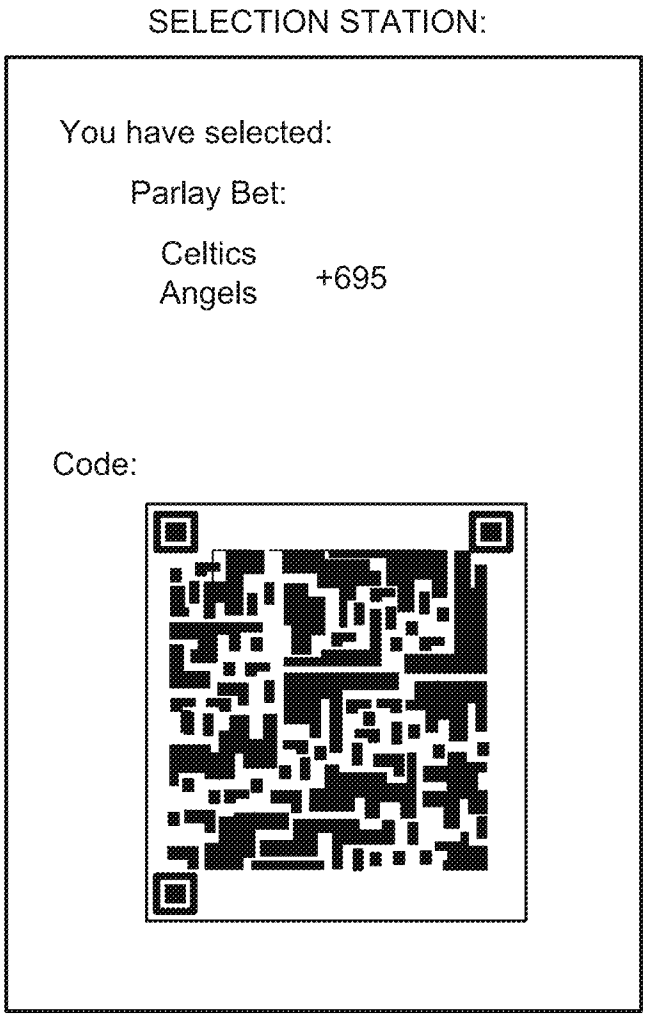
FIG. 5A illustrates an exemplary user interface of a wager selection station in accordance with some embodiments.
Figure 6B:
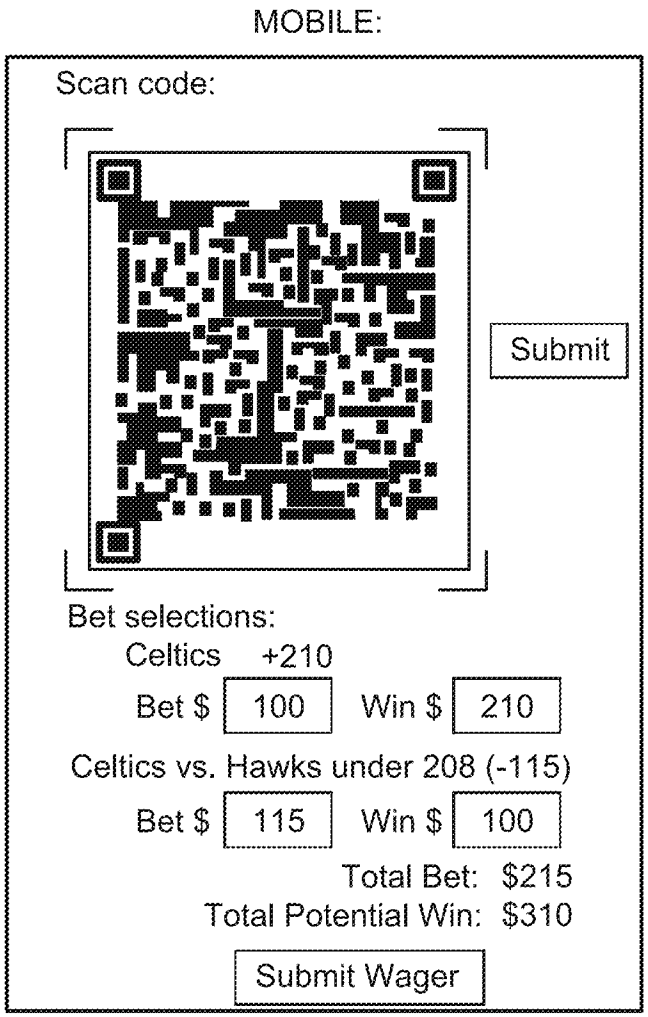
FIG. 6B illustrates an exemplary user interface of a mobile device software application in accordance with some embodiments.
Figure 6A:
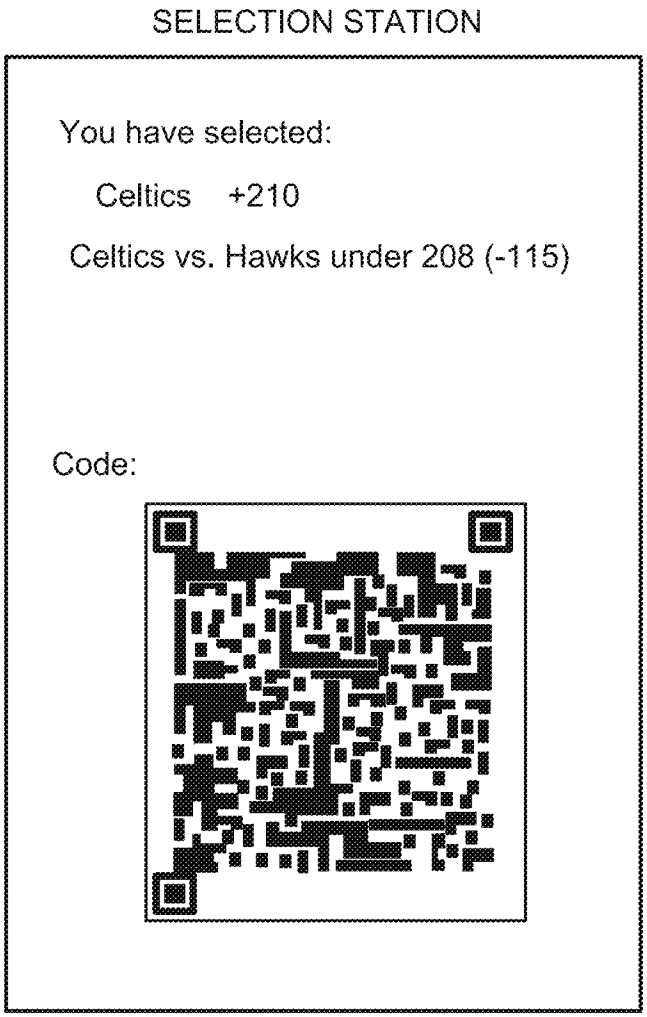
FIG. 6A illustrates an exemplary user interface of a wager selection station in accordance with some embodiments.

FIGS. 4A, 5A, and 6A are examples of user interface displays, which may be displayed on a display of a wager selection station, identifying selected event parameters and an optical code from which those event parameters may be derivable. The example user interface display shown in FIG. 4A indicates that the user has made the selection of "Celtics +210," signifying a single straight moneyline wager that the Celtics will win their game against the Hawks with a wagering odd of +210. The QR code displayed on the exemplary user interface of FIG. 4A encodes a unique reference for this single straight moneyline wager. The example user interface shown in FIG. 5A indicates that the user has made the selection of "Celtics" and "Angels" as winning their respective sports games, in a parlay wager that the Celtics will win their game against the Hawks and the Angels will win their game against the White Sox, with a wagering odd of +695. The QR code displayed on the exemplary user interface of FIG. 5A encodes a unique reference for this parlay wager. The example user interface shown in FIG. 6A indicates that the user has made the two selections "Celtics +210," signifying a prediction that the Celtics will win their game with a wagering odd of +210, and "Celtics v. Hawks Under 208(−115)," signifying a prediction that the total number of points in the Celtics and Hawks game will be below 208 points with a wagering odd of −115. This type of selection is an example of a multiple straight wager where there are separate wagering odds for each event. The QR code displayed on the exemplary user interface of FIG. 6A encodes a unique reference for this multiple straight wager.

In some embodiments, the wager selection station may be pre-populated with one or more optical codes associated with different event parameters selected by another user (e.g., another patron of the sportsbook, an operator of the sportsbook). In this case, a user of the wager selection station may view the optical codes on a display of the selection station without having to enter in selections for event parameters.

As discussed above, machine-readable optical codes may be printed on a physical medium in some embodiments. For example, a sportsbook venue may print flyers, posters, and/or cards with an optical code that encodes a unique reference for one or more event parameters. Patrons of the sportsbook venue may scan the printed optical codes as part of placing a wager on an event without having to interact with a wager selection station in such embodiments.

At act 210 of method 200, a user may operate a mobile device to scan the optical code, such as by using an imaging device of the mobile device. FIGS. 4B, 5B, and 6B are examples of user interface displays, which may be displayed on a mobile device, e.g., by execution of a software application of the electronic wagering system. FIGS. 4B, 5B, and 6B each include a framed region in which the current field of view of the mobile device's imaging device may be displayed. The user may watch the display in this framed region to position the machine-readable optical code (e.g., a QR code) in the field of view of the imaging device. The user may then select the "Submit" icon in the examples of FIGS. 4B, 5B, and 6B, which may initiate scanning of the code by operating the imaging device to capture and store an image of the code having been framed in the appropriate field of view of the imaging device.

At act 220, the mobile device (e.g., via execution of the software application) may decode the optical code to retrieve the unique reference, such as by applying an optical code reader program or routine to the captured image of the optical code to decode it and retrieve the unique reference. Multiple users may scan the same optical code displayed on the wager selection station, in some embodiments. A user may alternatively receive the optical code (e.g., an image of the optical code) and/or the unique reference at the mobile device from another user, such as by one user sending the optical code and/or unique reference in an email, text message, and/or sharing on social media (e.g., Twitter, Facebook, Instagram). In addition, wagering service operators may publish optical codes and/or unique references that they generate on social media, in some embodiments. In this manner, a user may access the optical code and/or unique reference without having to be present at a sportsbook venue. In some embodiments, a user may share the optical code and/or unique reference in a link such that activating of the link opens a software application for viewing the event parameters associated with the optical code and/or unique reference.

At act 214, the mobile device may transmit the unique reference to a server, such as server 110. The server may derive the event parameters specified by the unique reference at act 216. As discussed above, the server may derive the event parameters by applying an algorithm or process in a reverse of the process used to generate the unique reference from the event parameters, in some embodiments. The server may transmit the event parameters to the mobile device at act 218, in some embodiments.

At act 220, the mobile device may be operated to display the event parameters received from the server on a display. FIGS. 4B, 5B, and 6B illustrate examples of user interface displays, which may be displayed on a mobile device, identifying selected event parameters for the different types of wagers shown in FIGS. 4A, 5A, and 6A, respectively, as bet selections made by the user. FIG. 4B displays the single straight moneyline bet selection of the Celtics winning their game. FIG. 5B displays the parlay bet selection of the Celtics and the Angels both winning their respective games. FIG. 6B displays the multiple straight bet of the Celtics winning their game with the Hawks and the total number of points scored in the game being less than 205. A user may view the parameters selected prior to placement of a wager, in some embodiments.

At act 222 of exemplary method 200, the mobile device (e.g., via the executing software application) may request authentication information from the user. (This is merely one example, however. In other examples, authentication information may be requested at any one or more of various other times, such before scanning the optical code at act 210, before decoding the optical code at act 212, before transmitting the unique reference to the server at act 214, before displaying the event parameters at act 220, before any later acts in the method, any time the software application times out from inactivity, etc.) As an example, the software application executing on the mobile device may prompt a user to enter in their username and password associated with a user account as part of verifying that the user is the correct authorized user of the mobile device. As another example, the software application executing on the mobile device may prompt a user to scan their fingerprint using a fingerprint scanner of the mobile device as a way to authenticate the user. If the authentication information does not verify the user as an authorized user, then the user may not proceed with placing a wager, in some embodiments.

At act 224, the mobile device may receive user input indicating a wager instruction. FIGS. 4B, 5B, and 6B illustrate examples of user interface displays, which may be displayed on a mobile device, identifying selected event parameters for the different types of wagers shown in FIGS. 4A, 5A, and 6A, respectively. In FIGS. 4B and 5B, a user may enter a monetary amount in the text field next to "Enter wager amount" and submit the wager by selecting "Submit Wager." In FIG. 6B, a user may enter a monetary amount for each bet selection and the user interface may display the user's potential winnings based on the entered monetary amount. In the example shown in FIG. 6B, a user has entered "$100" as his wager that the Celtics will win their game (which would provide him with a win of $210), and "$115" as his wager that the total number of points scored in the game will be under 208 (which would provide him with a win of $100). The exemplary user interface of FIG. 6B totals the monetary amounts as "$215" and the total potential win as "$310." The user may submit this wager in this example by selecting the "Submit Wager" icon. In this manner, a user may view a sum of their potential winnings prior to submitting the wager instruction, in some embodiments. In this example, if the wager is lost, then the user will lose $215; if the wager is won, then the user will keep the $215 and win an additional $310.

At act 226, the mobile device may transmit to the server a request to place a wager on behalf of the user. A request to place a wager may be transmitted in response to user input in some embodiments, such as selection of "Submit Wager"

as shown in each of FIGS. 4B, 5B, and 6B. The server may place the wager on the user's behalf in response to receiving the request at act 228. The server may also store an indication of placement of the wager in association with information identifying the user (e.g., a user account). At act 230, the server may transmit a receipt to the mobile device. The mobile device may display the receipt to the user at act 232. In some embodiments, the receipt may be used by the user to obtain their payout if they win the wager. For example, the user may show the receipt on the display of the mobile device to an employee of the sportsbook, such as an employee at a cashout counter of the sportsbook, who may then prove the user with their winnings. In other embodiments, a financial account associated with the user may be automatically credited with the user's winnings if the user has won the wager.

Figure 2B:
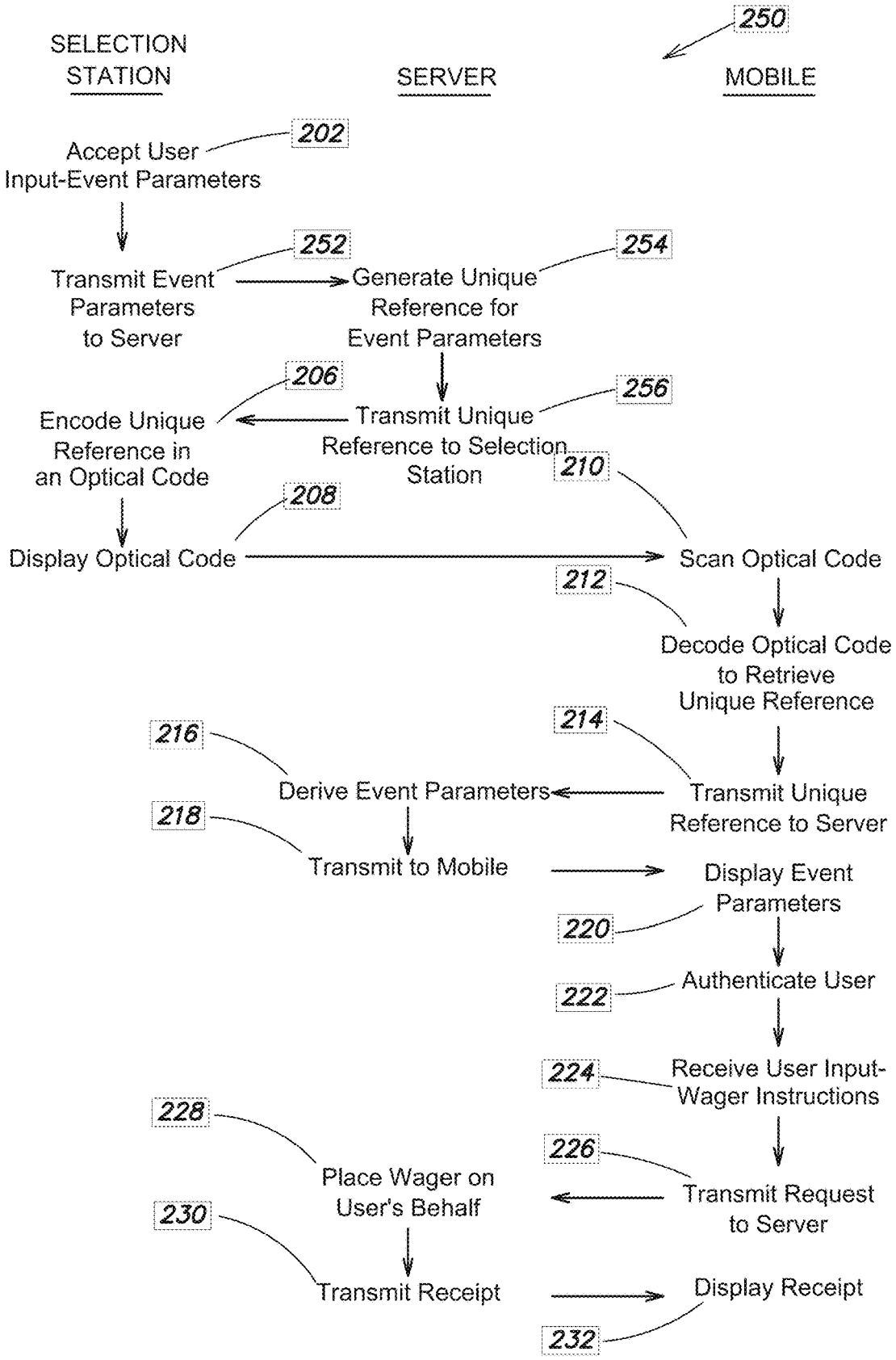
FIG. 2B is a flowchart illustrating an exemplary process of selecting and placing a wager in accordance with some embodiments.

In some embodiments, the algorithm or process for generating the unique reference may be stored on the server. FIG. 2B illustrates another exemplary method 250 for selecting and placing a wager, in which some of the acts are the same as in method 200 as shown in FIG. 2A. After act 202 where the wager selection station accepts user input specifying event parameters, method 250 proceeds to act 252 where the wager selection station may transmit the event parameters to the server. At act 254, the server may generate the unique reference for the event parameters. As discussed above, an algorithm or process stored on the server may apply the algorithm or process to the specified event parameters to generate a unique reference. The server may transmit the unique reference to the wager selection station at act 256. After act 256, method 250 includes the same remaining acts as in method 200 discussed above.

Figure 7:
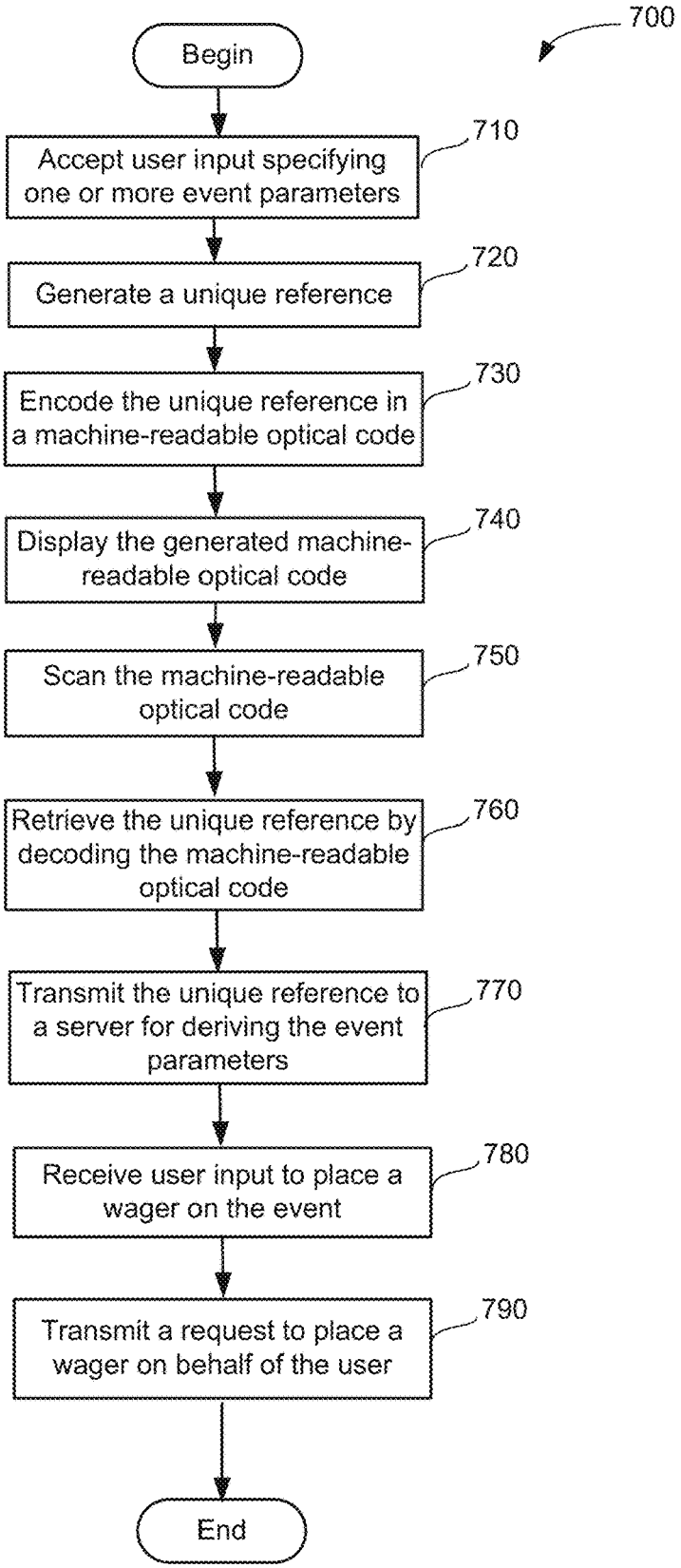
FIG. 7 is a flowchart of an exemplary method for placing a wager in accordance with some embodiments.

It should be appreciated from the foregoing that another embodiment is directed to a method 700 for placing a wager, as illustrated in FIG. 7. Method 700 may be performed, for example, by electronic wagering system 100. The electronic wagering system may include a wager selection station that has at least one output display and at least one input mechanism. In some embodiments, the wager selection station may include a touchscreen providing the at least one display and the at least one user input mechanism.

Method 700 begins at act 710, at which at least one processor of the wager selection station may accept, via the at least one user input mechanism, user input specifying one or more parameters of an event on which to place a wager. In some embodiments, the event on which the wager is placed may be a sports event.

At act 720, the processor(s) of the wager selection station may generate a unique reference from which the specified event parameters are derivable. At act 730, the processor(s) of the wager selection station may encode the unique reference in a machine-readable optical code. At act 740, the wager selection station may display the generated machine-readable optical code on the at least one output display.

The electronic wagering system may also include a software application including a set of software instructions that operate the user's mobile communication device when executed. The mobile communication device may be owned by the user, in some embodiments. At act 750, the software application may operate the mobile communication device to scan the displayed machine-readable optical code from the at least one output display of the wager selection station via an imaging device of the mobile communication device. At act 760, the software application may operate the mobile communication device to retrieve the unique reference by decoding the scanned machine-readable optical code.

The electronic wagering system may also include a server configured to derive the user-specified event parameters from the unique reference. At act 770, the software application may operate the mobile communication device to transmit the decoded unique reference to the server, via a network communication interface of the mobile communication device, for deriving the specified event parameters from the unique reference at the server. At act 780, the software application may operate the mobile communication device to receive user input at the mobile communication device to place a wager on the event with the specified parameters derived from the unique reference at the server. At act 790, the software application may operate the mobile communication device to transmit a request to the server to place the wager on behalf of the user.

Figure 8:
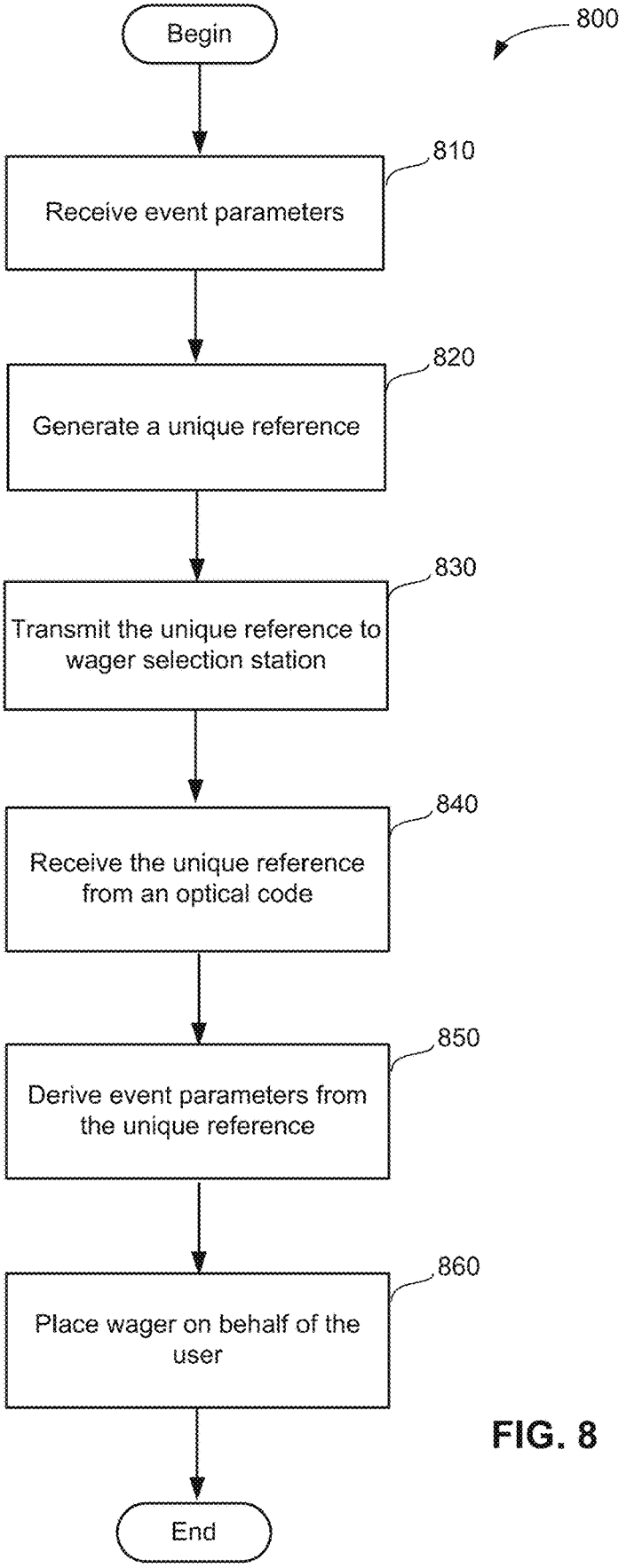
FIG. 8 is a flowchart of an exemplary method for placing a wager in accordance with some embodiments.

It should be appreciated from the foregoing that another embodiment is directed to a method 800 for placing a wager, as illustrated in FIG. 8. Method 800 may be performed, for example, by a wagering server system, such as server 110. The wagering server system may include at least one network communication interface, at least one processor, and at least one storage medium storing processor-executable instructions that, when executed by the processor, perform method 800.

Method 800 begins at act 810, at which the wagering server system may receive, from a wager selection station via the at least one network communication interface, parameters of an event on which to place a wager, specified by user input entered via the wager selection station.

At act 820, the wagering server system may generate a unique reference from which the specified event parameters are derivable at the server. The unique reference may be suitable for encoding in a machine-readable optical code. At act 830, the wagering server system may transmit the generated unique reference to the wager selection station for encoding and display to the user as the machine-readable optical code at the wager selection station. At act 840, the wagering server system may receive the unique reference back again from a mobile communication device of the user via the at least one network communication interface. The machine-readable optical code may have been scanned by the user's mobile communication device from the wager selection station, and the unique reference may have been decoded from the scanned machine-readable optical code. In some embodiments, the mobile communication device may be owned by the user.

At act 850, the wagering server system may derive the user-specified event parameters from the unique reference received from the mobile communication device. At act 860, the wagering server system may place a wager on behalf of the user on the event with the specified parameters derived from the unique reference. In some embodiments, the event on which the wager is placed may be a sports event. The parameters of the sports event on which to place the wager may include one or more specified sports matches in which the event is to occur, one or more specified sports teams to be involved in the event, one or more specified sports players to be involved in the event, one or more predicted winners of one or more specified sports matches, one or more specified plays to be performed in the event, one or more specified scores to be achieved in the event, one or more specified score differences to be achieved in the event, and/or one or more specified time periods in which the event is to occur.

In some embodiments, method 800 may further include transmitting the event parameters derived from the unique reference to the mobile communication device for display to the user at the mobile communication device. In some embodiments, method 800 may further include receiving from the mobile communication device a request to place the wager on behalf of the user, wherein the wager is placed in response to receiving the request. In some embodiments, method 800 may further include receiving from the mobile communication device an indication of a monetary amount of the wager to be placed, specified by user input via the mobile communication device. In some embodiments, method 800 may further include receiving from the wager selection station an indication of a monetary amount of the wager to be placed, specified by user input entered via the wager selection station, wherein generating the unique reference comprises generating a unique reference from which the monetary amount of the wager and the specified event parameters are derivable.

Figure 9:
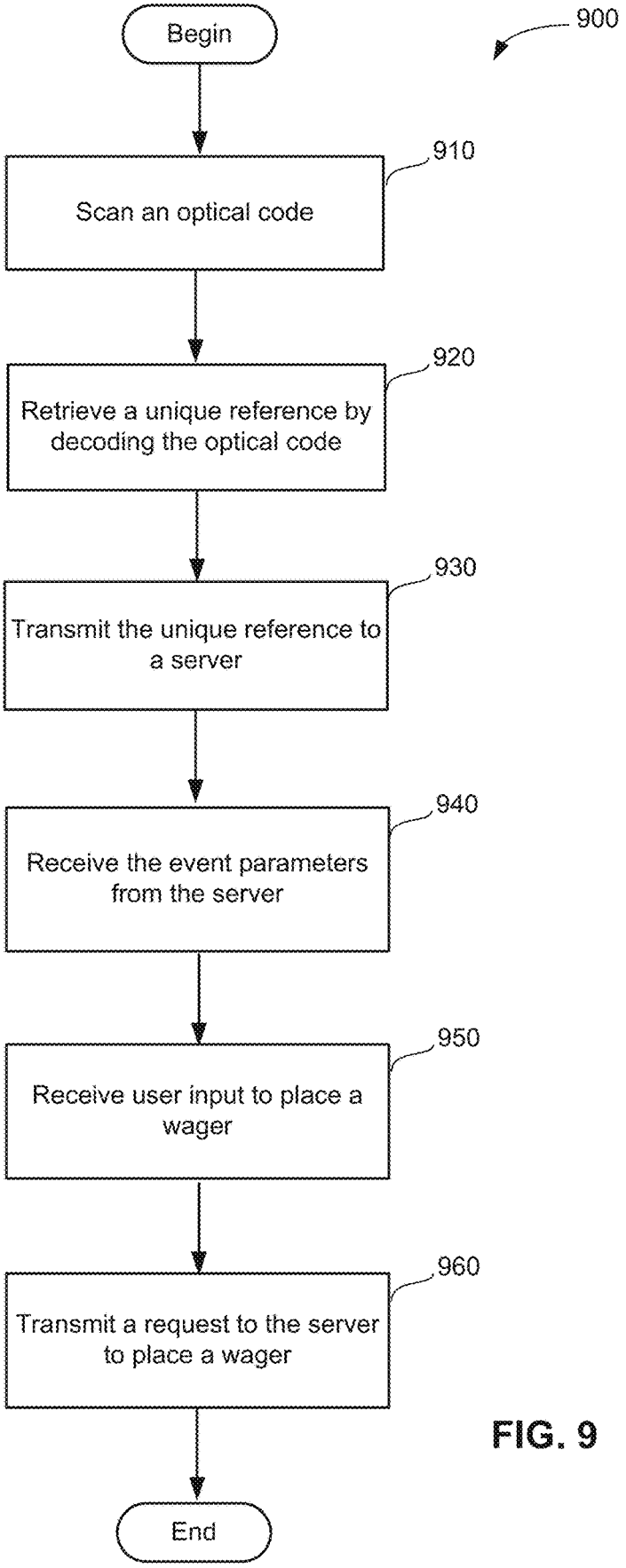
FIG. 9 is a flowchart of an exemplary method for placing a wager in accordance with some embodiments.

It should be appreciated from the foregoing that another embodiment is directed to a method 900 for placing a wager, as illustrated in FIG. 9. Method 900 may be performed, for example, by a mobile communication device, such as mobile device 130. Method 900 begins at act 910, at which the mobile communication device may scan a machine-readable optical code via an imaging device of the mobile communication device. In some embodiments, scanning the machine-readable optical code may include scanning the machine-readable optical code displayed on an electronic display screen. In some embodiments, scanning the machine-readable optical code may include scanning the machine-readable optical code printed on a physical medium.

At act 920, mobile communication device my retrieve a unique reference by decoding the machine-readable optical code. At act 930, the mobile communication device may transmit the unique reference, via a network communication interface of the mobile communication device, to a server. The server may derive from the unique reference one or more specified parameters of an event on which to place a wager. In some embodiments, the event on which the wager is placed may be a sports event. The parameters of the sports event on which to place the wager may include one or more specified sports matches in which the event is to occur, one or more specified sports teams to be involved in the event, one or more specified sports players to be involved in the event, one or more predicted winners of one or more specified sports matches, one or more specified plays to be performed in the event, one or more specified scores to be achieved in the event, one or more specified score differences to be achieved in the event, and/or one or more specified time periods in which the event is to occur.

At act 940, the mobile communication device may receive from the server, via the network communication interface, the specified event parameters derived from the unique reference at the server. At act 950, the mobile communication device may receive user input at the mobile communication device to place a wager on the event with the specified parameters. In some embodiments, the user input to place the wager may comprise user input specifying a monetary amount of the wager. At act 960, the mobile communication device may transmit a request to the server to place the wager on behalf of the user.

In some embodiments, method 900 may further include receiving from the server an indication of a monetary amount of the wager to be placed, derived from the unique reference at the server. In some embodiments, method 900 may further include requiring user authentication before transmitting the request to the server to place the wager on behalf of the user. In some embodiments, method 900 may further include sharing the scanned machine-readable optical code with another user by transmitting the scanned machine-readable optical code from the mobile communication device to a device of the other user.

Figure 10:
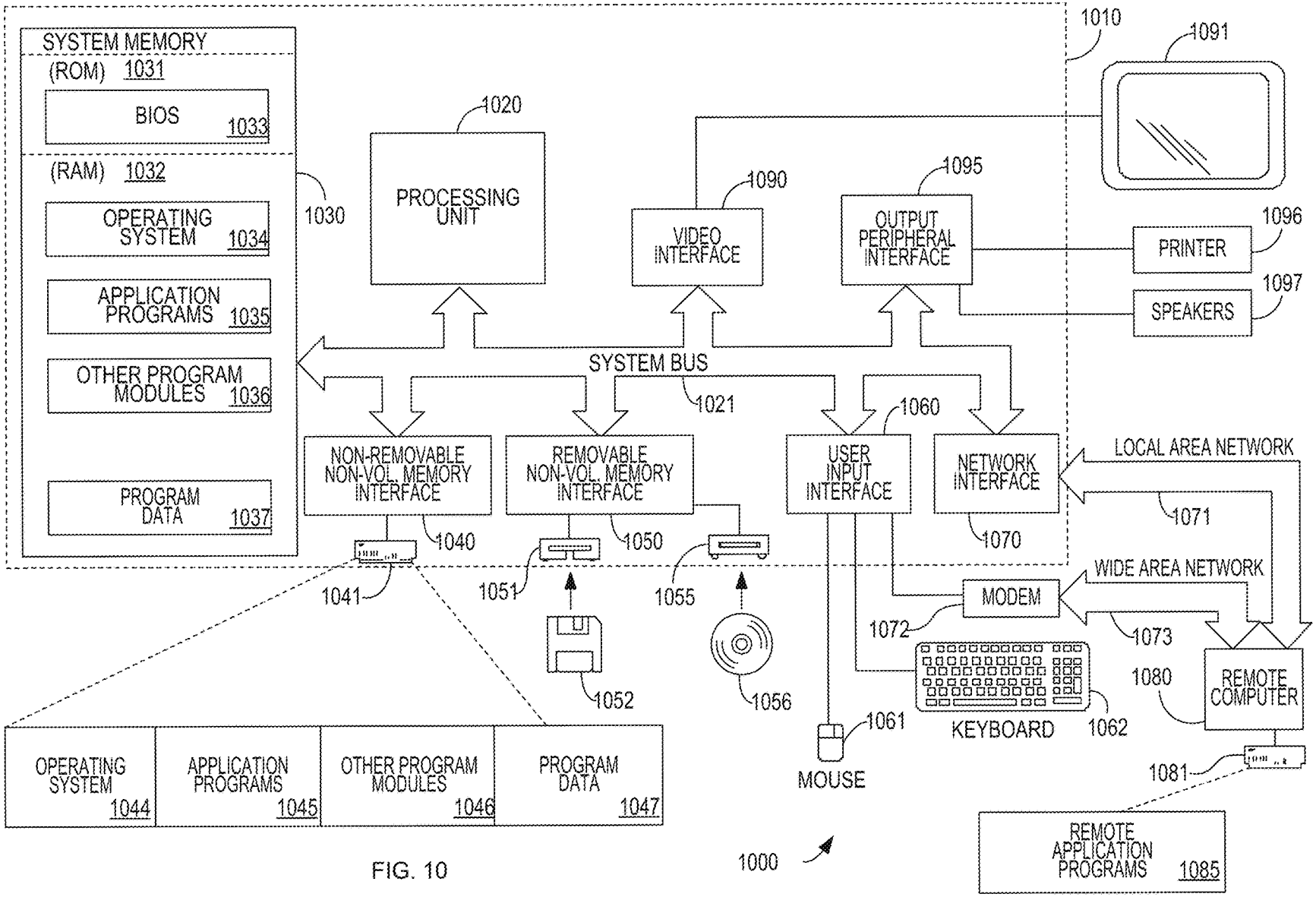
FIG. 10 is a block diagram illustrating an exemplary computing system environment in which some embodiments may be implemented.

FIG. 10 illustrates an example of a suitable computing system environment 1000 in which some embodiments may be implemented. A computing system such as the example illustrated in FIG. 10 may be used in some embodiments to implement server 110 and/or wager selection station 120, for example. However, it should be appreciated that the computing system environment 1000 is only one example of a suitable computing environment and is not intended to suggest any limitation as to the scope of use or functionality of the described embodiments. Neither should the computing environment 1000 be interpreted as having any dependency or requirement relating to any one or combination of components illustrated in the exemplary operating environment 1000. For example, some embodiments of a computing system usable with techniques described herein (e.g., to implement any of the system components described herein, such as server 110 and/or wager selection station 120) may include more or fewer components than illustrated in the example of FIG. 10.

Embodiments are operational with numerous other computing system environments or configurations. Examples of well-known computing systems, environments, and/or configurations that may be suitable for use with the described techniques include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The computing environment may execute computer-executable instructions, such as program modules. Generally, program modules include routines, programs, objects, components, data structures, etc., that perform particular tasks or implement particular abstract data types. The embodiments may also be practiced in distributed computing environments where tasks are performed by remote processing devices that are linked through a communications network. In a distributed computing environment, program modules may be located in both local and remote computer storage media including memory storage devices.

With reference to FIG. 10, an exemplary system for implementing the described techniques includes a computing device in the form of a computer 1010. Components of computer 1010 may include, but are not limited to, a processing unit 1020, a system memory 1030, and a system bus 1021 that couples various system components including the system memory to the processing unit 1020. The system bus 1021 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 1010 typically includes a variety of computer readable media. Computer readable media can be any available media that can be accessed by computer 1010 and includes both volatile and nonvolatile media, removable and non-removable media. By way of example, and not limitation, computer readable media may comprise computer storage media and communication media. Computer storage media include both volatile and nonvolatile, removable and non-removable media implemented in any method or technology for storage of information such as computer readable instructions, data structures, program modules or other data. Computer storage media are non-transitory and include, but are not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other non-transitory medium which can be used to store the desired information and which can accessed by computer 1010. Communication media typically embody computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared and other wireless media. Combinations of the any of the above should also be included within the scope of computer readable media.

The system memory 1030 includes computer storage media in the form of volatile and/or nonvolatile memory such as read only memory (ROM) 1031 and random access memory (RAM) 1032. A basic input/output system 1033 (BIOS), containing the basic routines that help to transfer information between elements within computer 1010, such as during start-up, is typically stored in ROM 1031. RAM 1032 typically contains data and/or program modules that are immediately accessible to and/or presently being operated on by processing unit 1020. By way of example, and not limitation, FIG. 10 illustrates operating system 1034, application programs 1035, other program modules 1036, and program data 1037.

The computer 1010 may also include other removable/non-removable, volatile/nonvolatile computer storage media. By way of example only, FIG. 10 illustrates a hard disk drive 1041 that reads from or writes to non-removable, nonvolatile magnetic media, a magnetic disk drive 1051 that reads from or writes to a removable, nonvolatile magnetic disk 1052, and an optical disk drive 1055 that reads from or writes to a removable, nonvolatile optical disk 1056 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 1041 is typically connected to the system bus 1021 through a non-removable memory interface such as interface 1040, and magnetic disk drive 1051 and optical disk drive 1055 are typically connected to the system bus 1021 by a removable memory interface, such as interface 1050.

The drives and their associated computer storage media discussed above and illustrated in FIG. 10 provide storage of computer-readable instructions, data structures, program modules and other data for the computer 1010. In FIG. 10, for example, hard disk drive 1041 is illustrated as storing operating system 1044, application programs 1045, other program modules 1046, and program data 1047. Note that these components can either be the same as or different from operating system 1034, application programs 1035, other program modules 1036, and program data 1037. Operating system 1044, application programs 1045, other program modules 1046, and program data 1047 are given different numbers here to illustrate that, at a minimum, they are different copies. A user may enter commands and information into the computer 1010 through input devices such as a keyboard 1062 and pointing device 1061, commonly referred to as a mouse, trackball or touch pad. Other input devices (not shown) may include a microphone, joystick, game pad, satellite dish, scanner, touchscreen, or the like. These and other input devices are often connected to the processing unit 1020 through a user input interface 1060 that is coupled to the system bus, but may be connected by other interface and bus structures, such as a parallel port, game port or a universal serial bus (USB). A monitor 1091 or other type of display device is also connected to the system bus 1021 via an interface, such as a video interface 1090. In addition to the monitor, computers may also include other peripheral output devices such as speakers 1097 and printer 1096, which may be connected through an output peripheral interface 1095.

The computer 1010 may operate in a networked environment using logical connections to one or more remote computers, such as a remote computer 1080. The remote computer 1080 may be a personal computer, a server, a router, a network PC, a peer device or other common network node, and typically includes many or all of the elements described above relative to the computer 1010, although only a memory storage device 1081 has been illustrated in FIG. 10. The logical connections depicted in FIG. 10 include a local area network (LAN) 1071 and a wide area network (WAN) 1073, but may also include other networks. Such networking environments are commonplace in offices, enterprise-wide computer networks, intranets and the Internet.

When used in a LAN networking environment, the computer 1010 is connected to the LAN 1071 through a network interface or adapter 1070. When used in a WAN networking environment, the computer 1010 typically includes a modem 1072 or other means for establishing communications over the WAN 1073, such as the Internet. The modem 1072, which may be internal or external, may be connected to the system bus 1021 via the user input interface 1060, or other appropriate mechanism. In a networked environment, program modules depicted relative to the computer 1010, or portions thereof, may be stored in the remote memory storage device. By way of example, and not limitation, FIG. 10 illustrates remote application programs 1085 as residing on memory device 1081. It will be appreciated that the network connections shown are exemplary and other means of establishing a communications link between the computers may be used.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with non-dedicated hardware (e.g., one or more processors) that is programmed using microcode or software to perform the functions recited above.

In this respect, it should be appreciated that one implementation comprises at least one computer-readable storage medium (i.e., at least one tangible, non-transitory computer-readable medium, e.g., a computer memory (e.g., hard drive, flash memory, processor working memory, etc.), a floppy disk, an optical disc, a magnetic tape, or other tangible, non-transitory computer-readable medium) encoded with a computer program (i.e., a plurality of instructions), which, when executed on one or more processors, performs above-discussed functions. The computer-readable storage medium can be transportable such that the program stored thereon can be loaded onto any computer resource to implement functionality discussed herein. In addition, it should be appreciated that the reference to a computer program which, when executed, performs above-discussed functions, is not limited to an application program running on a host computer. Rather, the term "computer program" is used herein in a generic sense to reference any type of computer code (e.g., software or microcode) that can be employed to program one or more processors to implement above-discussed techniques.

The phraseology and terminology used herein is for the purpose of description and should not be regarded as limiting. The use of "including," "comprising," "having," "containing," "involving," and variations thereof, is meant to encompass the items listed thereafter and additional items. Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Several embodiments having been described in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. An electronic wagering system comprising:

a wager selection station having an output display and a user input mechanism, the wager selection station comprising a first processor circuit and a first storage medium storing first processor-executable instructions that cause the first processor circuit of the wager selection station to:

accept, via the user input mechanism, first user input specifying event parameters of a future event on which wagers may be placed, the future event occurring external to the electronic wagering system;

generate a unique reference from which the event parameters are derivable;

encode the unique reference in a machine-readable optical code; and display the machine-readable optical code on the output display;

a server comprising a second processor circuit and a second storage medium storing second processor-executable instructions that cause the second processor circuit of the server to:

receive the unique reference from a mobile communication device;

derive the event parameters from the unique reference;

determine, based on the event parameters derived from the unique reference, a wager on the future event with the event parameters;

transmit an indication of the wager to the mobile communication device;

receive a request from the mobile communication device to place the wager; and in response to receiving the request to place the wager, cause the wager to be placed; and a software application comprising a set of software instructions that, when executed by the mobile communication device, operate the mobile communication device to:

scan the machine-readable optical code from the output display of the wager selection station via an imaging device of the mobile communication device;

retrieve the unique reference by decoding the machine-readable optical code;

transmit the unique reference to the server via a network communication interface of the mobile communication device, for deriving the event parameters from the unique reference at the server;

receive the indication of the wager from the server;

receive second user input at the mobile communication device to place the wager; and transmit the request to the server to place the wager.

2. The electronic wagering system of claim 1, wherein the future event comprises a sports event.

3. The electronic wagering system of claim 1, wherein the wager selection station comprises a touchscreen providing the output display and the user input mechanism.

4. The electronic wagering system of claim 1, wherein the software application further operates the mobile communication device to, before transmitting the request to the server to place the wager, transmit an authentication request message to the server requesting authentication of the mobile communication device, and before transmitting the request to the server to place the wager, receive an authentication response from the server authenticating the mobile communication device in response to the authentication request message.

5. A wagering server system comprising:

a network communication interface;

a processor circuit coupled to the network communication interface;

and a storage medium coupled to the processor circuit and storing processor-executable instructions that, when executed by the processor circuit, cause the processor circuit to:

receive, from a wager selection station via the network communication interface, event parameters of a future event on which wagers may be placed, specified by first user input entered via the wager selection station, the future event occurring external to the wagering server system;

generate a unique reference from which the event parameters are derivable, the unique reference being suitable for encoding in a machine-readable optical code;

cause the unique reference to be encoded in the machine-readable code;

cause the wager selection station to display the machine-readable code to a user at the wager selection station;

receive, from a mobile communication device via the network communication interface, the unique reference having been decoded from the machine-readable optical code scanned by the mobile communication device from the wager selection station;

derive the event parameters from the unique reference received from the mobile communication device;

determine, based on the event parameters derived from the unique reference, a wager on the future event with the event parameters;

transmit an indication of the wager to the mobile communication device;

receive a request from the mobile communication device to place the wager; and cause the wager on the future event to be placed.

6. The wagering server system of claim 5, wherein the future event comprises a sports event.

7. The wagering server system of claim 5, wherein the event parameters of the future event comprise one or more of:

one or more specified sports matches in which the future event is to occur, one or more specified sports teams to be involved in the future event, one or more specified sports players to be involved in the future event, one or more predicted winners of one or more specified sports matches, one or more specified plays to be performed in the future event, one or more specified scores to be achieved in the future event, one or more specified score differences to be achieved in the future event, and one or more specified time periods in which the future event is to occur.

8. The wagering server system of claim 5, wherein the processor-executable instructions further cause the processor circuit to transmit the event parameters derived from the unique reference to the mobile communication device for display at the mobile communication device.

9. The wagering server system of claim 5, wherein the processor-executable instructions further cause the processor circuit to receive from the mobile communication device an indication of a monetary amount of the wager to be placed, specified by user input via the mobile communication device.

10. The wagering server system of claim 5, wherein the processor-executable instructions further cause the processor circuit to receive from the wager selection station an indication of a monetary amount of the wager to be placed, specified by the first user input entered via the wager selection station, wherein generating the unique reference comprises generating a unique reference from which the monetary amount of the wager and the event parameters are derivable.

11. The wagering server system of claim 5, wherein the processor-executable instructions further cause the processor circuit to:

receive the event parameters, generate the unique reference, cause the unique reference to be encoded in the machine-readable code, and cause the wager selection station to display the machine readable code without requiring authentication of the user at the wager selection station; and before causing the wager on the future event to be placed, authenticate a user of the mobile communication device.

12. A computer-implemented wagering method comprising:

scanning a machine-readable optical code via an imaging device of a mobile communication device;

retrieving a unique reference by decoding the machine-readable optical code;

transmitting the unique reference, via a network communication interface of the mobile communication device, to a server of an electronic wagering system for deriving from the unique reference, at the server, event parameters of a future event on which wagers may be placed, the future event occurring external to the electronic wagering system;

receiving from the server, at the mobile communication device via the network communication interface, the event parameters derived from the unique reference at the server;

receiving user input at the mobile communication device to place a wager on the future event with the event parameters; and transmitting a request to the server to place the wager.

13. The computer-implemented wagering method of claim 12, wherein scanning the machine-readable optical code comprises scanning the machine-readable optical code displayed on an electronic display screen of a wager selection station.

14. The computer-implemented wagering method of claim 12, wherein scanning the machine-readable optical code comprises scanning the machine-readable optical code printed on a physical medium.

15. The computer-implemented wagering method of claim 12, wherein the future event comprises a sports event.

16. The computer-implemented wagering method of claim 12, wherein the event parameters of the future event comprise one or more of:

one or more specified sports matches in which the future event is to occur, one or more specified sports teams to be involved in the future event, one or more specified sports players to be involved in the future event, one or more predicted winners of one or more specified sports matches, one or more specified plays to be performed in the future event, one or more specified scores to be achieved in the future event, one or more specified score differences to be achieved in the future event, and one or more specified time periods in which the future event is to occur.

17. The computer-implemented wagering method of claim 12, wherein the user input to place the wager comprises a monetary amount of the wager.

18. The computer-implemented wagering method of claim 12, the method further comprising receiving from the server an indication of a monetary amount of the wager to be placed, derived from the unique reference at the server.

19. The computer-implemented wagering method of claim 12, the method further comprising, before transmitting the request to the server to place the wager, transmitting an authentication request message to the server requesting authentication of the mobile communication device, and before transmitting the request to the server to place the wager, receiving an authentication response from the server authenticating the mobile communication device in response to the authentication request message.

20. The computer-implemented wagering method of claim 12, the method further comprising sharing the scanned machine-readable optical code and/or the unique reference by transmitting the scanned machine-readable optical code and/or the unique reference from the mobile communication device to a second device.

* * * * *